US006061025A

United States Patent [19]

Jackson et al.

[11] Patent Number: 6,061,025

[45] Date of Patent: May 9, 2000

[54] TUNABLE MICROSTRIP PATCH ANTENNA AND CONTROL SYSTEM THEREFOR

[75] Inventors: Trent M. Jackson, Greenbelt; William E. McKinzie, III, Fulton; James D. Lilly, Silver Spring; Andrew Humen, Jr., Crofton, all of Md.

[73] Assignee: Atlantic Aerospace Electronics Corporation, Greenbelt, Md.

[21] Appl. No.: 08/968,216

[22] Filed: Nov. 12, 1997

Related U.S. Application Data

[63] Continuation-in-part of application No. 08/568,940, Dec. 7, 1995, Pat. No. 5,777,581.

[51] Int. Cl.[7] ..... H01Q 1/38

[52] U.S. Cl. ..... 343/700 MS; 343/745

[58] Field of Search ..... 343/700 MS, 745, 343/815, 816, 817, 818, 846; H01Q 1/38

[56] References Cited

U.S. PATENT DOCUMENTS

| | | | |
|---|---|---|---|
| 4,751,513 | 6/1988 | Daryoush et al. | 343/700 |
| 5,281,974 | 1/1994 | Kuramoto et al. | 343/700 |
| 5,309,163 | 5/1994 | Ngan et al. | 343/700 |
| 5,420,596 | 5/1995 | Burrell et al. | 343/700 |
| 5,777,581 | 7/1998 | Lilly et al. | 343/700 |

*Primary Examiner*—David H. Vu
*Assistant Examiner*—Tho Phan
*Attorney, Agent, or Firm*—Pillsbury, Madison & Sutro LLP; Mark J. Danielson

[57] ABSTRACT

A patch antenna is provided with one or more tuning strips spaced therefrom and RF switches to connect or block RF currents therebetween. When a control system for the antenna selectively connects and isolates RF currents between certain of the tuning strips and the patch, the tuning strips change the effective length of the patch and thus the antenna's resonant frequency, thereby frequency tuning the antenna electrically over a relatively broad band of frequencies. The control system includes circuitry for rapidly switching the antenna to a desired frequency with minimal delay and with superior isolation from the antenna, making it suitable for use in DAMA, TDMA, and other frequency hopping applications.

29 Claims, 18 Drawing Sheets

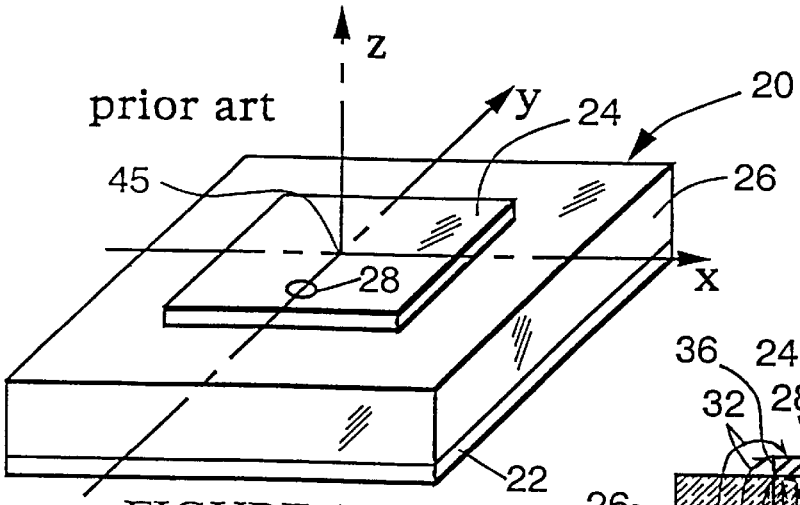
FIGURE 1
FIGURE 2
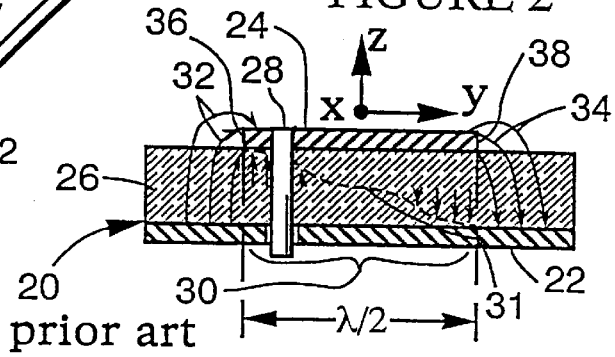
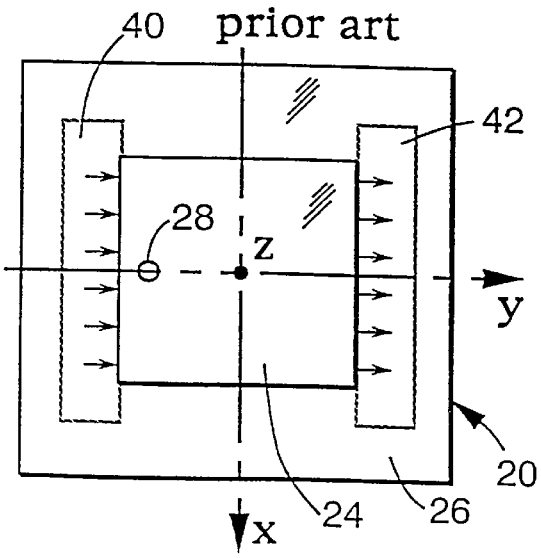
FIGURE 3
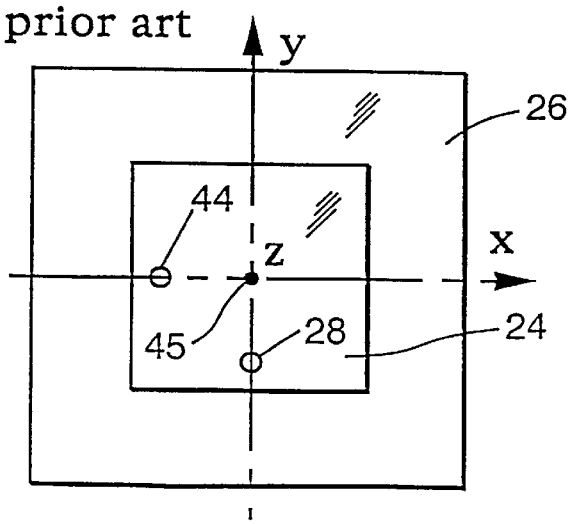
FIGURE 4

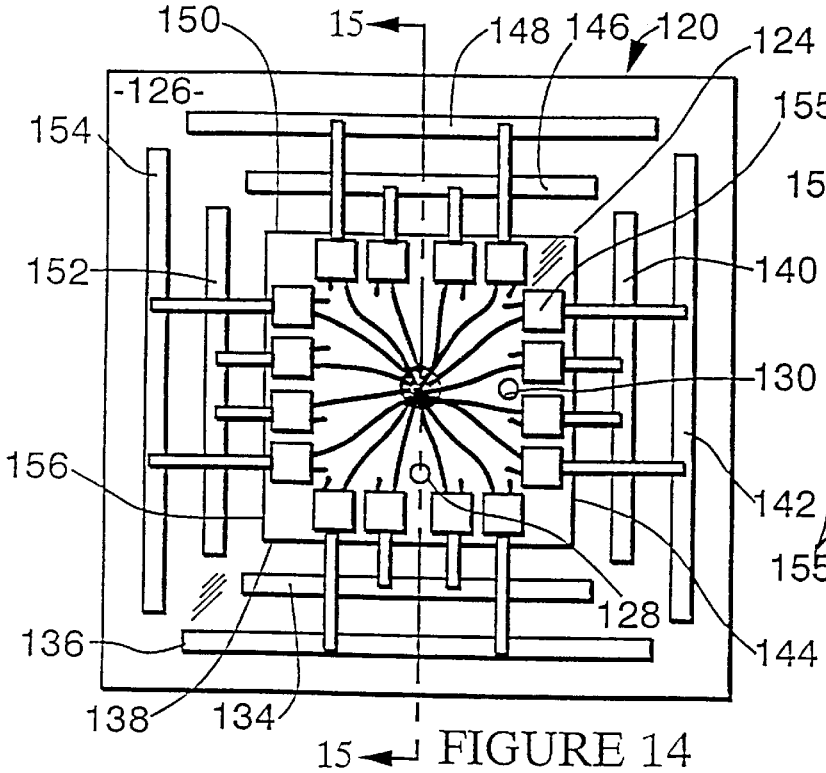
FIGURE 14
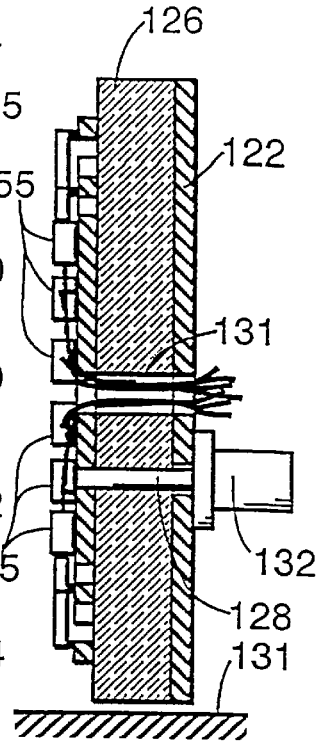
FIGURE 15
FIGURE 16
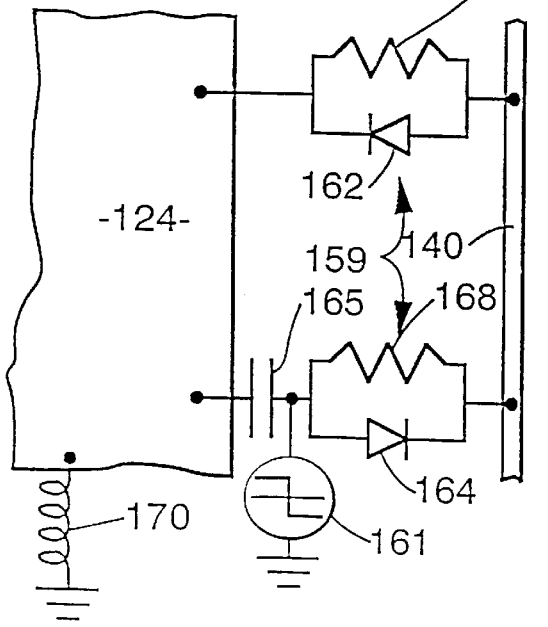
FIGURE 17
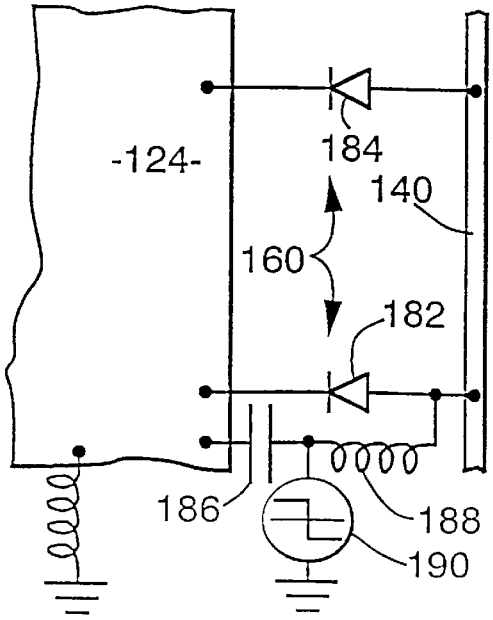

FIGURE 29
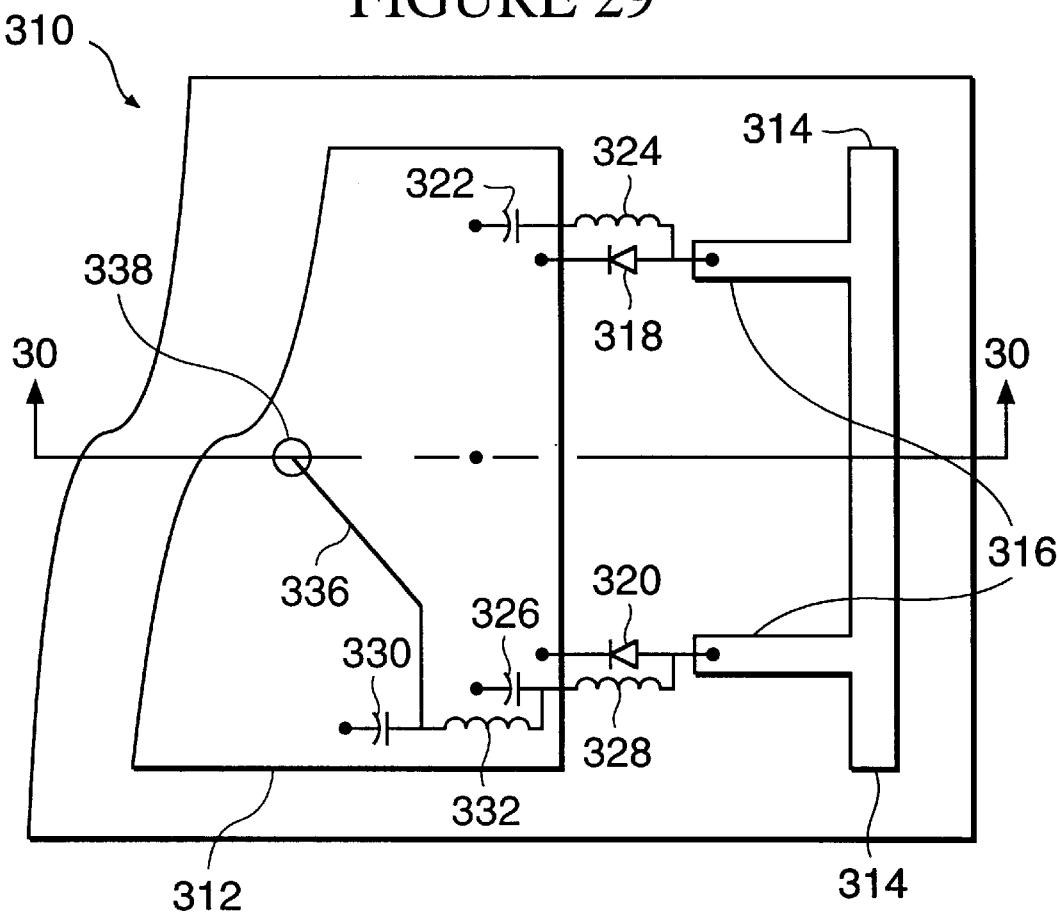
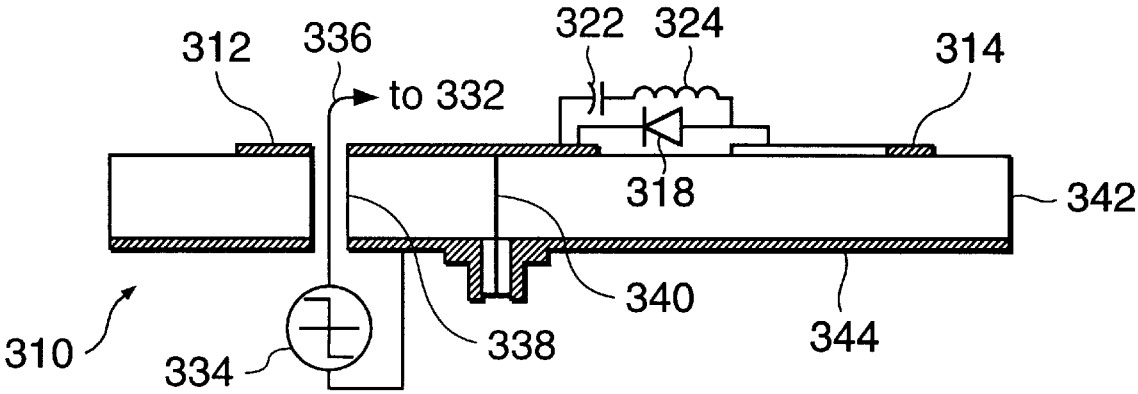
FIGURE 30

FIGURE 31
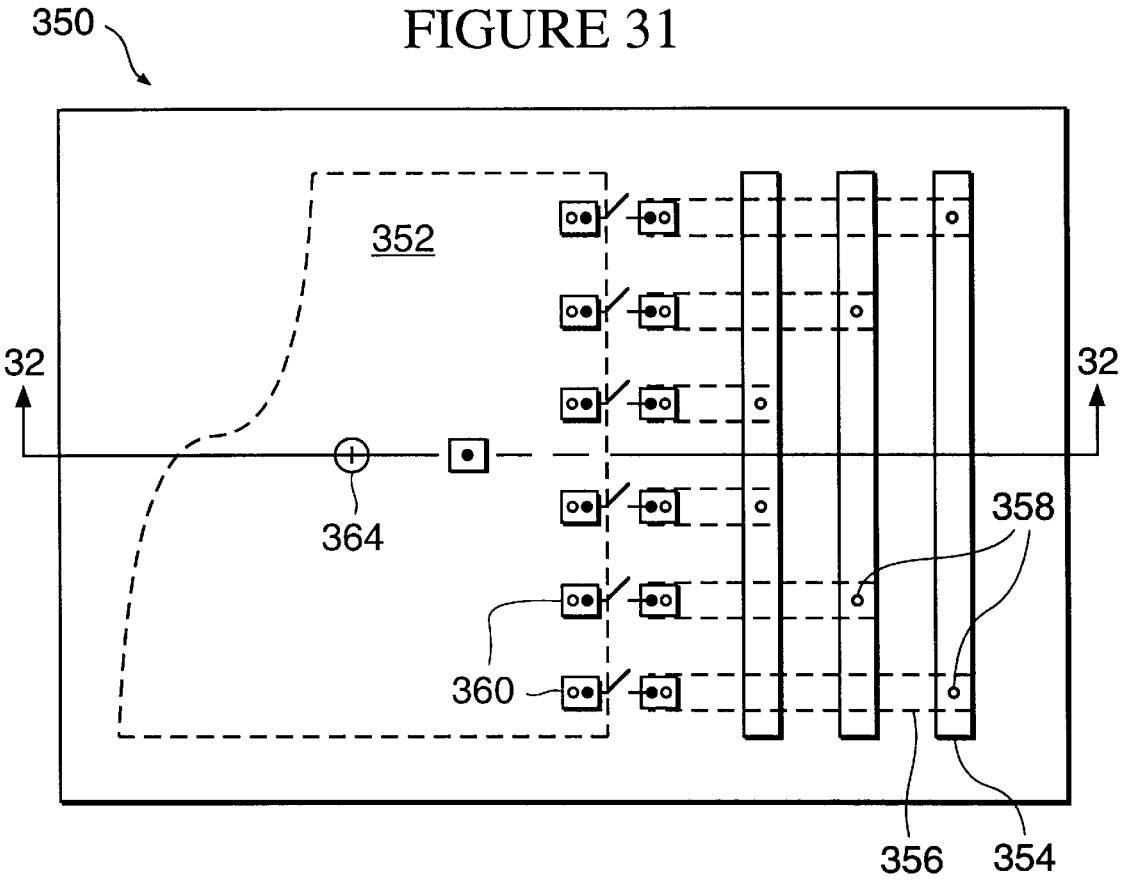
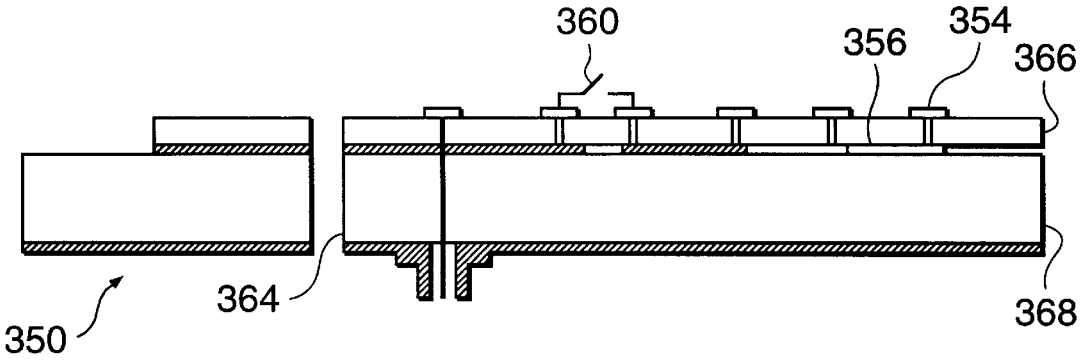
FIGURE 32

TUNABLE MICROSTRIP PATCH ANTENNA AND CONTROL SYSTEM THEREFOR

This is a Continuation-in-part (CIP) of 08/568,940, Dec. 7, 1995, U.S. Pat. No. 5,777,581.

BACKGROUND OF THE INVENTION

Many applications require small, light weight, efficient conformal antennas. Traditionally, microstrip patch antennas have been preferred where only a narrow frequency band is used, since microstrip patch antennas typically are efficient only in a narrow frequency band. Advantages of these antennas include their capability of being mounted in a small space, of having high gain, and of being constructed in a rugged form. Such advantages have made them the antennas of choice in many applications.

In contrast to the narrowband performance of conventional microstrip patch antennas, satellite communication (Satcom) systems and other similar communications systems, require antennas that are functional across a relatively broad band of frequencies. Typical military broadband applications include long range communication links for smart weapon targeting and real time mission planning and reporting. A variety of antenna designs, such as crossed slots, spirals, cavity-backed turnstiles, and dipole/monopole hybrids have been used for similar applications over at least the last 15 years. However, most of these broadband antennas require large installation footprints. Particularly, a typical UHF antenna requires a square which is two to three feet on a side. When used on aircraft, these antennas intrude into the aircraft by as much as 12" and can protrude into the airstream as much as 14". For airborne Satcom applications, antennas of this size are unacceptably large, especially on smaller aircraft, and difficult to hide on larger aircraft, where it is undesirable to advertise the presence of a UHF Satcom capability. Therefore, there has been a need for highly efficient broadband antennas having the size, weight, and durability advantages provided by narrowband microstrip patch antennas.

Of further concern, in Demand Assigned Multiple Access (DAMA) operations, for example, UHF Satcom antenna systems require switching times between frequencies of as fast as 875 microseconds. Accordingly, an antenna system for use in such operations, as well as in TDMA and other frequency hopping applications, must be compatible with such requirements and must include control circuitry that can configure the broadband antenna with minimal delay.

Moreover, various operating conditions can alter the performance characteristics of a microstrip antenna. For example, temperature on a microstrip patch substrate can change the resonant frequency of the patch, causing the antenna to be improperly tuned. Accordingly, an antenna system should include control circuitry that can monitor such operating conditions and configure the antenna to account for them.

SUMMARY OF THE INVENTION

Therefore, it is an object of the present invention to provide a small, light weight, efficient, broadband antenna.

Another object of the present invention is to provide a broadband antenna, which can be tuned for efficient operation at a single frequency and whose antenna pattern can be tailored electronically.

Another object is to provide an electronically tunable antenna that is relatively easy and economical to manufacture.

Another object is to provide a tunable antenna that is useful over a wide range of applications and frequencies.

Another object is to provide an electrically small, broadband, tunable, efficient antenna, which can handle high power.

Another object is to provide an antenna that can be installed conformally to an arbitrarily curved surface.

Another object is to provide electronically tunable antennas that can be scaled for various frequency bands.

Another object is to provide an electronically tunable antenna with specific polarization or whose polarization can be changed or varied.

Another object is to provide a compact, conformal, light weight, efficient antenna system that can be rapidly tuned to a desired frequency for compatibility with DAMA, TDMA and other frequency hopping operations.

Another object is to provide a control system for a compact, conformal, light weight, broadband antenna that can rapidly configure the antenna for tuning to a desired frequency while isolating the high voltage of the PIN diodes from the antenna's programmable control circuitry.

Another object is to provide a control system for a compact, conformal, light weight, broadband antenna that can rapidly configure the antenna for tuning to a desired frequency while achieving an appropriate balance of radiation efficiency and power consumption.

Another object is to provide a control system for a compact, conformal, light weight, broadband antenna that can account for operating conditions when tuning the antenna to a desired frequency.

The present invention achieves these and other objects with a tunable microstrip patch antenna that is small, light weight and broadband. The small size enables use in the aforementioned applications where larger, less efficient, and/or narrow band antennas have heretofore been used. Although the antenna is discussed as if it is a transmitting antenna, it should be apparent that the same principles apply when it is being used as a receiving antenna. The antenna includes a conductive patch, generally parallel to and spaced from a conducting ground plane by an insulator, and fed at one or more locations through the ground plane and the insulator. The shape of the patch and the feed points determine the polarization and general antenna pattern of the antenna. Surrounding the patch are conductive strips. Circuitry is provided to allow the strips to participate in the function of the antenna or to isolate the strips from such function. When the strips participate, they effectively increase the size of the patch and lower its optimal operation frequency.

The participation of the strips can be accomplished in various ways. A preferred method uses diodes and means to either forward or reverse bias the diodes into conductive or nonconductive conditions. The diodes can be used to connect the strips to the main patch, or to ground them to the ground plane to prevent capacitive coupling between the strips and the patch from being effective. Typically the strips are arranged in segmented concentric rings about the patch, the rings having the same approximate edge shape as the patch. Normally, the strips are connected to the patch progressively outwardly from the patch to lower the frequency of the antenna. However, various combinations of the strips may be connected or disconnected to tune the antenna to specific frequencies or to change the associated gain pattern.

Although UHF Satcom is a prime candidate for application of the present invention, and is discussed hereinafter in that context, nowhere herein is this meant to imply any limitation and potential use of frequency or of operation and in fact the present antennas are useful in many different antenna applications, such as UHF line of sight communications, signal intercept, weapons data link, identification friend-or-foe ("IFF") and multi-function applications combining these and/or other functions.

Conventional UHF Satcom antennas provide an instantaneous bandwidth of approximately 80 Mhz covering the frequency band from 240 to 320 Mhz. The present antennas can be configured to cover the required 80 Mhz bandwidth with a number of sub-bands each with less instantaneous bandwidth than 80 MHz, but far more than required for system operation by any user. Since the present antenna may be tuned to operate at any sub-band, it thereby can be used to cover the entire 240 to 320 MHz Satcom band in a piece-wise fashion. The relatively narrow instantaneous bandwidth of the present antennas allow substantial size and weight reduction relative to conventional antennas and acts like a filter to reject unwanted out-of-subband signals, thereby reducing interference from nearby transmitters, jammers and the like.

The present antennas include tuning circuitry, thereby minimizing the need for external function and support hardware. The prior art microstrip patch configuration is modified to include conducting metal strips or bars spaced from and generally parallel to the basic patch element. Switching elements bridge the gaps between the basic patch element and the conducting metal strips. The switching elements allow any combination of the adjacent strips to be selected such that they are either electrically connected to or isolated from the basic patch. Switching components include PIN diodes, FETs, bulk switchable semiconductors, relays and mechanical switches. When, for example, PIN diodes are used, the present antenna is compatible with electronic control. That is, in response to DC currents, the antenna can be dynamically tuned for operation at specific RF frequencies. Because the control is electronic, very rapid tuning is possible—rapid enough, in fact, to support DAMA, TDMA and other frequency hopping applications.

A control system for use with the present antennas includes bias control circuitry that dynamically tunes the antenna to a desired frequency by electronically biasing the switching elements (e.g. PIN diodes) to connect certain combinations of tuning elements to the basic patch element while isolating other of the tuning elements from the basic patch element. Preferably, the bias control circuitry uses photovoltaic relays to isolate the high DC voltages of the PIN diodes from the low voltage programmable control circuitry. In addition to controlling the application of correct biasing voltages, the control system can control the amount of bias current supplied to the switching elements in accordance with desired radiation efficiency and power consumption parameters. The control system can also include interface circuitry for receiving tuning commands and programmable control circuitry for controlling the bias control circuitry in response to the tuning commands. Further, the control system can employ operating condition monitors, such as temperature monitors, to monitor the conditions under which the antenna is operating so that the programmable control circuitry can control the bias control circuitry in an appropriate manner to account for such operating conditions when tuning the antenna.

BRIEF DESCRIPTION OF THE DRAWINGS

These and other objects and advantages the present invention will become apparent to those skilled in the art after considering the following detailed specification, together with the accompanying drawings wherein:

FIG. 1 is a perspective view of a prior art microstrip patch antenna;

FIG. 2 is a cross sectional view taken along the y-axis of FIG. 1.

FIG. 3 is a top plan view of the antenna of FIG. 1 showing the virtual radiating slots thereof;

FIG. 4 is a top plan view of a dual feed embodiment of the antenna of FIG. 1;

FIG. 14 is a top plan view of an antenna constructed according to the present invention, with its switch circuits, leads, and RF feeds;

FIG. 15 is a side cross-sectional view taken at line 15—15 of FIG. 14;

FIG. 16 is a circuit diagram of a switching circuit for connecting and disconnecting a tuning strip to the patch of the present antenna;

FIG. 17 is a circuit diagram of another switching circuit for connecting and disconnecting a tuning strip to the patch of the present antenna;

FIG. 29 is a top plan view of an antenna constructed according to the present invention with tuning circuits thereon;

FIG. 30 is a side plan view of the antenna illustrated in FIG. 29;

FIG. 31 is a top plan view of an antenna constructed according to the present invention with a dielectric superstrate assembled therewith;

FIG. 32 is a side plan view of the antenna illustrated in FIG. 31;

DETAILED DESCRIPTION OF THE PREFERRED EMBODIMENTS

Figure 5:
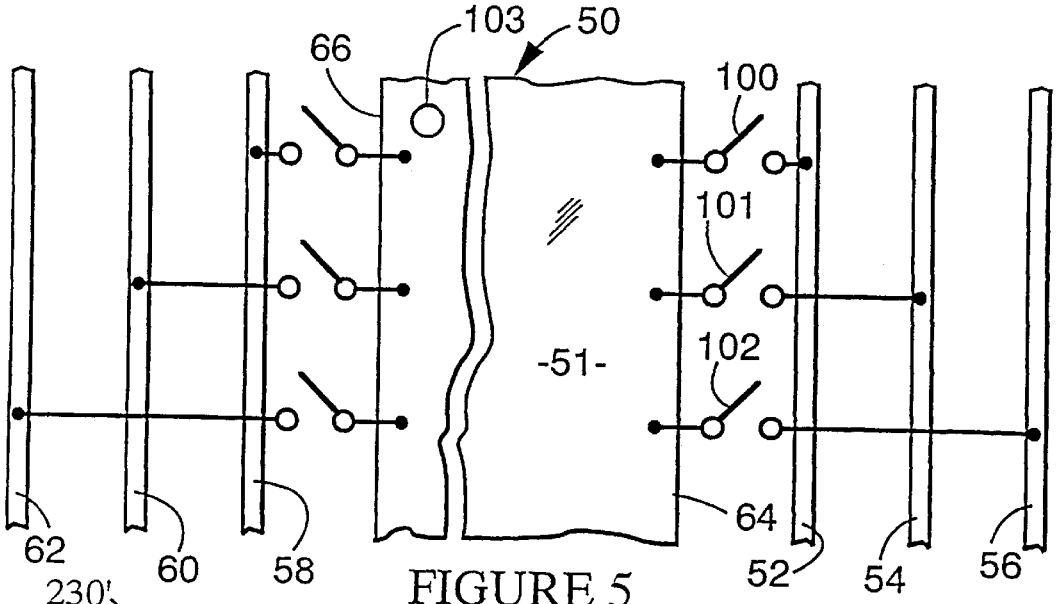
FIG. 5 is a partial diagrammatic plan view of an antenna constructed according to the present invention, showing a switch configuration thereof.

Referring to the drawings more particularly by reference numbers, number 20 in FIG. 1 refers to a prior art patch antenna that includes a conducting ground plane 22, a conducting patch 24 and a dielectric spacer 26 spacing the patch 24 parallel to and spaced from the ground plane 22. Suitable feed means 28 electrically insulated from the ground plane 22, extends therethrough and through the dielectric spacer 26 to feed RF energy to the patch 24. Although the patch 24 is shown as square in shape, it is also quite common to have circular patches either center fed or fed adjacent the edge as feed 28 is positioned. For any patch antenna operating in the lowest order mode, $TM_{11}$ for a circular patch and $T_{10}$ for a rectangular patch, a linearly polarized radiation pattern can be generated by exciting the patch 24 at a single feed point such as feed point 28. For antenna 20, which has a square patch that is a special case of a rectangular patch, the patch 24 generates a linearly polarized pattern with the polarization aligned with the y-axis. This can be understood by visualizing the antenna 20 as a resonant cavity 30 formed by the ground plane 22 and the patch 24 with open side walls as shown in FIG. 2. When excited at its lowest resonant frequency, the cavity 3 produces a standing half wave 31 ($\lambda/2$) when operating at the lowest order mode as shown, with fringing electric fields 32 and 34 at the edges 36 and 38 that appear as radiating slot 40 and 42 (FIG. 3). This electric field configuration has all field lines parallel with the y-axis and hence produces radiation with linear polarization. When a feed 44 is located on the x-axis as shown in FIG. 4, all electric field lines are aligned with the x-axis. If two feeds 28 and 44 are present simultaneously, one on the x-axis and the other on the y-axis as shown in FIG. 4, then two orthogonal electric fields are generated. Because the fields are orthogonal, they do not couple or otherwise affect each other and circular polarization results if the feeds are fed at 90 relative phase. With two feeds 28 and 44, four polarization senses can be generated. When feed 4 alone is used, there is linear horizontal polarization. When feed 28 only is used, there is linear vertical polarization. When feeds 28 and 44 are activated with feed 28 90° in phase behind feed 44, then the antenna 20 radiates RF signals with right hand circular polarization. When feed 28 is fed 90° ahead of feed point 44, left hand circular polarization results. Therefore, with two feeds and the ability to switch between them, any of the four polarizations can be generated from a single antenna 20.

As shown in FIG. 2, the maximum electric field is positioned at the edges 36 and 38 of the patch 24 whereas the minimum electric field occurs at the center 45 of the patch 24. At some intermediate positions between the center 45 and the edges of the patch 24, impedances occur that may match the characteristic impedance of the transmission line of feed 28. The feeds 28 and 44 are preferably placed so the impedances perfectly match.

Figure 6:
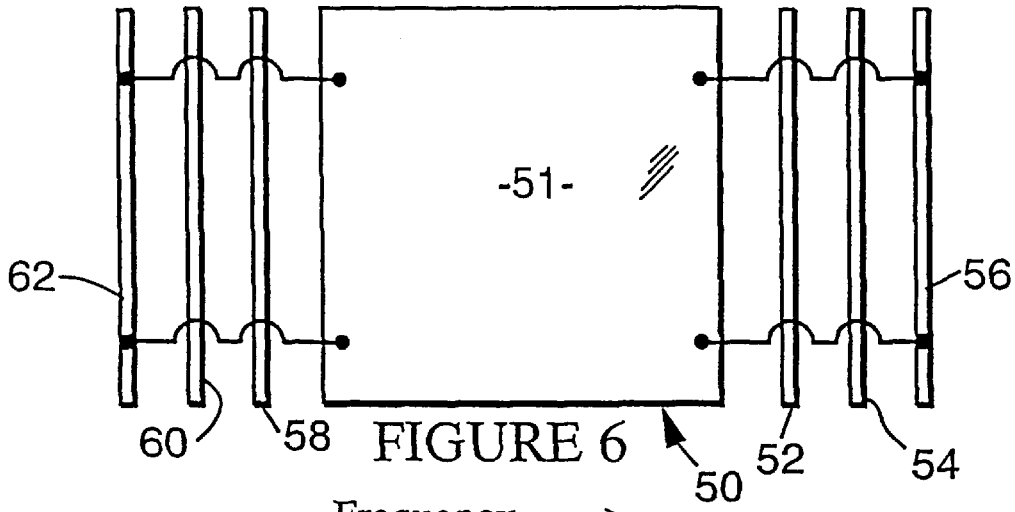
FIG. 6 is a top plan view showing how the tuning strips of an embodiment of the present invention can be connected to the patch thereof.
Figure 7:
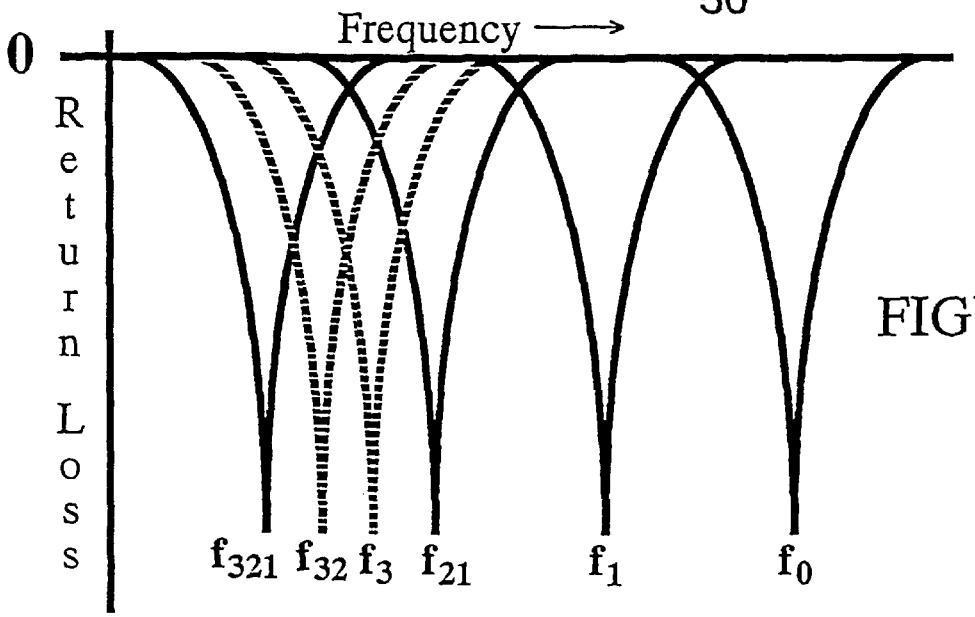
FIG. 7 is a graph of typical Frequency vs. Return Loss for various tuning states of the antenna of FIG. 6, where the frequency subscript designates the particular tuning strips electrically connected to the patch.

A simplified antenna 50 constructed according to the present invention is shown in FIG. 5 with only one polarization shown for simplicity. The antenna 50 and other antennas constructed in accordance with the present invention to be described hereinafter, are shown on a planar ground plane even though all of the present antennas can be curved within reason to conform to curved or compound curved surfaces of air vehicles or other supporting structures on or in which they may be mounted. The antenna 50 includes a patch 51 with three equally-spaced tuning bars or strips 52, 54, 56 and 58, 60 and 62 on opposite sides 64 and 66 of the patch 51. The resonant frequency of the antenna 50 is inversely proportional to the total effective patch length, that is the length of the patch 51 plus any of the strips 52 through 62 connected thereto. Therefore, the highest resonant frequency of the antenna 50 occurs when all of the strips 52 through 62 are disconnected from the patch 51. Possible operating states that can be generated with antenna 50 include $f_{highest}$ ($f_0$) for just the patch 51, $f_{mid\text{-}high}$ ($f_1$) for the patch 51 with strips 52 and 58 connected, $f_{mid\text{-}low}$ ($f_{21}$) for the patch 51 with strips 52, 54, 58 and 60 connected and $f_{lowest}$ ($f_{321}$) for the patch 51 with all of the strips 52 through 62 connected. However, the antenna 50 can be used with some of the outermost strips like 56 and 62 connected and the remaining strips disconnected (FIG. 6) to produce an operating frequency $f_3$ somewhat higher than $f_{lowest}$ ($f_{321}$) as shown in FIG. 7, which is a graph of return loss versus frequency. Another possible configuration has the patch 51 connected to strips 54, 56, 60 and 62 but not strips 52 and 58 to produce a frequency $f_{32}$ just above $f_{lowest}$. The extra frequencies that are possible by connecting different combinations of strips allow antennas of the present invention to be designed with fewer tuning strips and connecting components, while still providing continuous coverage over the frequency range of interest.

Figure 8:
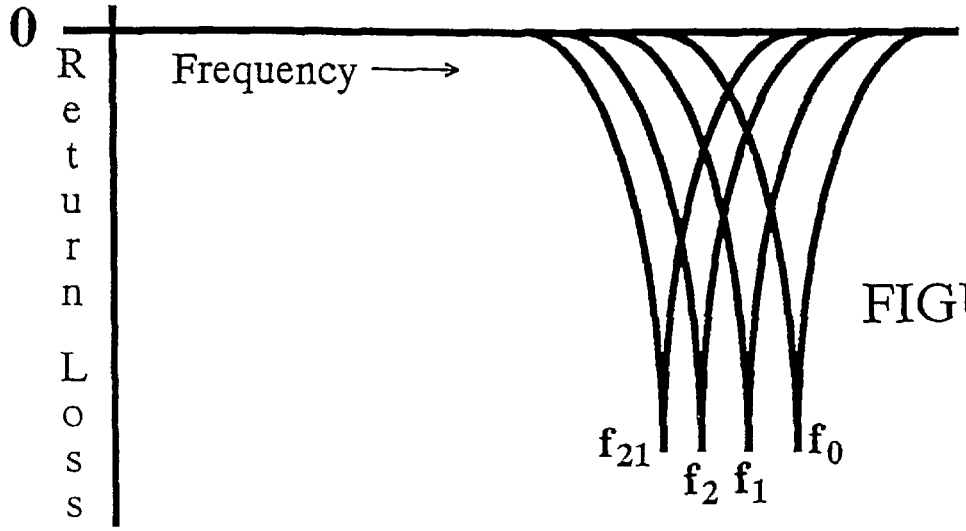
FIG. 8 is a graph of Frequency vs. Return Loss for the antenna of FIG. 9, which can be finely tuned.
Figure 9:
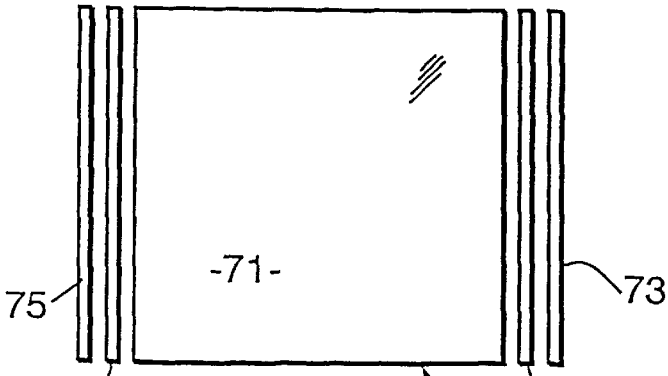
FIG. 9 is a partial top plan view of the tuning strips and patch of an antenna constructed according to the present invention, showing how tuning strips are positioned and spaced when the antenna is to be finely tuned at frequencies near the resonant frequency of the patch alone.
Figure 10:
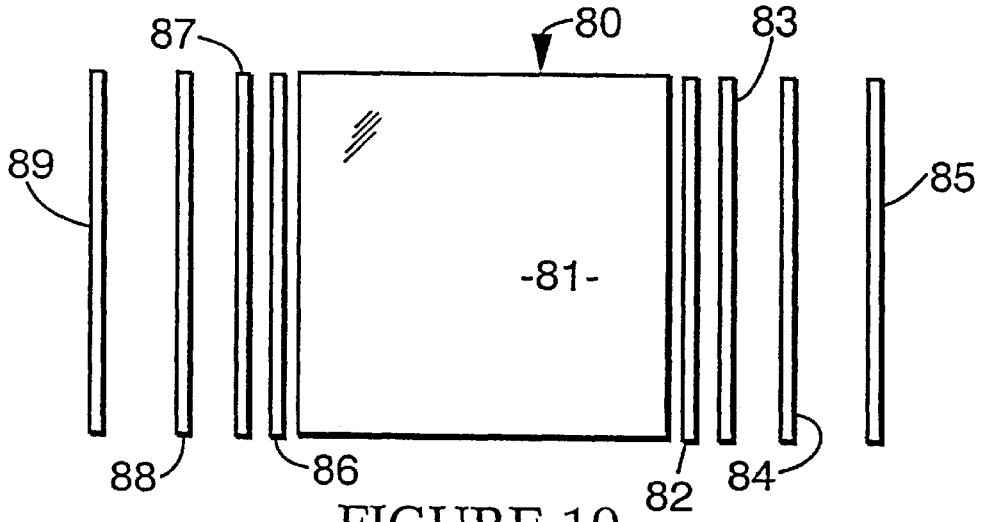
FIG. 10 is a partial top plan view of the tuning strips and patch of an antenna constructed according to the present invention, showing how tuning strips are positioned and spaced when the antenna is to cover a broad RF frequency band.
Figure 11:
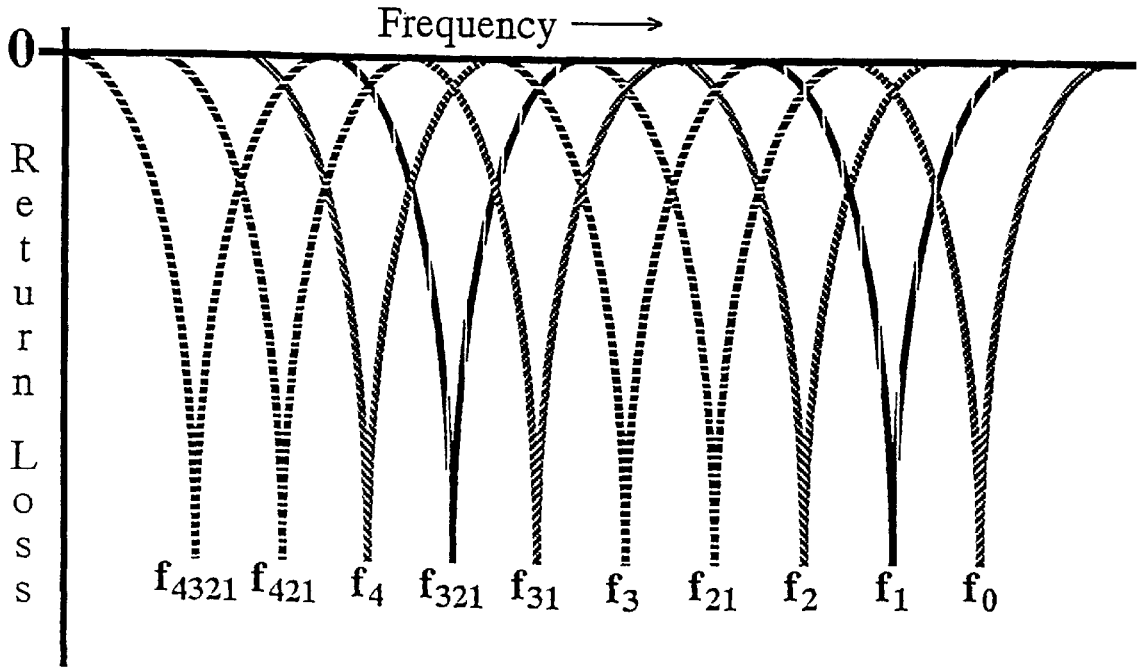
FIG. 11 is a graph of Frequency vs. Return Loss for various tuning states of the antenna of FIG. 10.

The tuning strips do not have to be equally spaced and fewer more widely spaced strips make the present antenna simpler and less costly to build. For the high frequency tuning states that employ only the innermost strips, these extra tuning states are less available. For example, if the frequency coverage shown in FIG. 8 is required, a patch of the antenna 71 with closely spaced tuning strips 72, 73, 74 and 75 can be used (FIG. 9). The strips 72 and 74 must be located sufficiently close to the patch 71 that frequency $f_1$ is generated. Any combination of other strips located further from the patch 71 will generate an operating frequency lower than $f_1$. Similarly, tuning strips 73 and 75 will generate the next lowest frequency $f_2$. Therefore, a broadband design may appear as shown in FIG. 10 by antenna 80, which includes patch 81 and tuning strips 82, 83, 84, 85, 86, 87, 88 and 89. Note the narrow spacing between the patch 81 and the strips 82 and 86 and then that the spacing increases outwardly as shown on FIG. 11, so a relatively even spread of frequencies can be obtained either by using individual strips or combinations, the frequencies being shown with subscript numbers indicating the connected strips counting outwardly from the patch 81. The resonant frequency of patch 81 alone is $f_0$.

Figure 12:
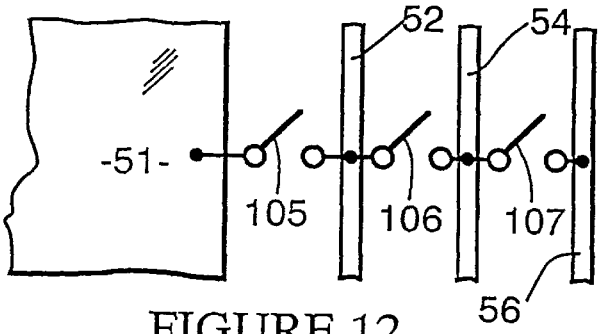
FIG. 12 is a partial diagrammatic plan view of an antenna constructed according to the present invention, showing an alternate switch configuration thereof.
Figure 13:
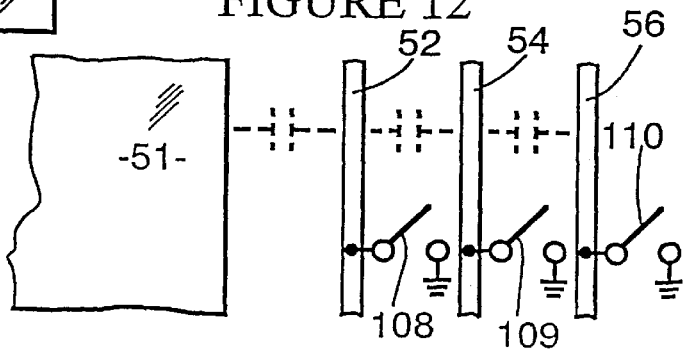
FIG. 13 is a partial diagrammatic plan view of an antenna constructed according to the present invention, showing a alternate switch configuration thereof that grounds the tuning strips rather than connects them to the patch, useful when the strips capacitively couple to the patch.

As shown in FIGS. 5, 12 and 13, the tuning strips 52, 54 and 56 can be coupled to the patch 51 by different switching arrangements. In FIG. 5, switches 100, 101 and 102 connect the tuning strips 52, 54 and 56 in parallel to the patch 51 so that any combination can be connected thereto. If only the strips 52, 54, and 56 are connected to the patch 51, the effect is to move the feed 103 percentage wise closer to the edge 66 to affect the antenna pattern and/or impedance match. In FIG. 12, switches 105, 106, and 107 connect the tuning strips 52, 54 and 56 in series. In this configuration, an interior tuning strip cannot be skipped to tune between what would normally be tuning strip frequencies. A high frequencies, the strips preferably are positioned very close together because they must be wide enough to carry the RF currents yet located at small distances from the patch. When they are positioned close to the patch, capacitance therebetween is high enough to couple RF between the strips and the patch and make the connection circuitry of FIGS. 5 and 12 ineffective to isolate the strips from the patch. Therefore, as shown in FIG. 13, switches 108, 109 and 110 are connected so they can ground the tuning strips 52, 54 and 56, which otherwise capacitively couple to the patch 51. In some instances, the switch connections of FIG. 13 and either FIG. 5 or 12 may need to be combined to get desired coupling and decoupling of the strips and the patch.

A microstrip patch antenna 120 constructed according to the present invention, whose thickness is exaggerated for clarity, can be seen in FIG. 14. The antenna 120 includes a conductive ground plane 122 and a square patch 124 supported and insulated from the ground plane 122 by a dielectric spacer 126. The patch 124 is fed by two leads 128 and 130, which are physically positioned at 90° to each other about the center hole 131 (FIG. 15) of the patch 124. When the antenna 120 is transmitting, the leads 128 and 130 connect RF signals that are electrically 90° degrees apart in phase to the patch 124 to produce circular polarization. As previously discussed, this causes the polarization of the antenna 120 to be right hand circular if lead 128 is fed 90° ahead of lead 130. If the phase difference of the leads 128 and 130 is reversed, the antenna 120 produces an output with left hand circular polarization. If the antenna 120 is oriented as shown in FIG. 15 at 90° to the earth 131, and only lead 130 is fed, then the antenna 120 produces an output signal with a linear horizontal polarization. When only lead 128 is feeding the antenna 120, then an output signal with a linear vertical polarization is produced. As shown in FIG. 15, a suitable connector 132 is provided on each of the leads 128 and 130 for connection to RF producing or receiving means, the leads 128 and 130 being insulated or spaced from the ground plane 122, as shown. Note that other connection means may be employed in place of the connector 132, such as microstrip lines, coplanar waveguide coupling apertures, and the like.

As aforesaid, relatively conventional patch antennas employing a patch 124 above a ground plane 122 and fed as described, are fairly conventional, efficient narrow frequency band devices. To increase the frequency coverage of the antenna 120 without affecting its antenna pattern, operation modes, or polarization, conductive frequency broadening strips are positioned on the spacer 126 parallel to and spaced from the patch 124 with strips 134 and 136 positioned near the lower edge 138 of the patch 124, strips 140 and 142 positioned near the right edge 144 of the patch 124, strips 146 and 148 positioned near the upper edge 150 of the patch 124, and strips 152 and 154 positioned near the left edge 156 of the patch 124.

When the strips 134, 140, 146 and 152 are connected by switch means 155 to the RF frequencies present at the patch 124, they effectively enlarge the patch 124 without changing its shape and thereby lower its resonant frequency. If in addition strips 136, 142, 148 and 154 are also connected to the patch 124, this further lowers the resonant frequency of the antenna 120. Intermediate frequencies can be gained by connecting only strips 136, 142, 148 and 154 to the patch 124 which has the effect of lowering the resonant frequency of the antenna 120 but not so much as if all strips were connected. In addition to changing the resonant frequency, the pattern of the antenna 120 can be changed by connecting the patch 124 to only opposite pairs of strips or connecting only the strips on one edge, adjacent edges or three edges. This allows the antenna pattern to be directed in a chosen direction to reduce an interfering signal near or at the frequency of interest. With the symmetrical antenna 120, in almost every combination, the connecting of the strips adjusts the resonant frequency of the antenna and/or adjusts its radiation pattern. With a non-symmetrical antenna of the present invention, it is difficult to change the resonant frequency without changing the antenna pattern.

Figure 18:
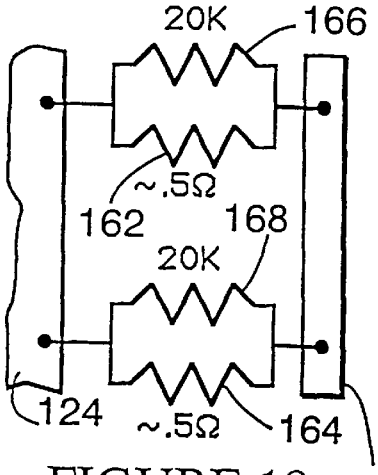
FIGS. 18 and 19 are equivalent circuit diagrams for the switching circuit of FIG. 16 when the circuit is connecting the patch to the tuning strip.
Figure 19:
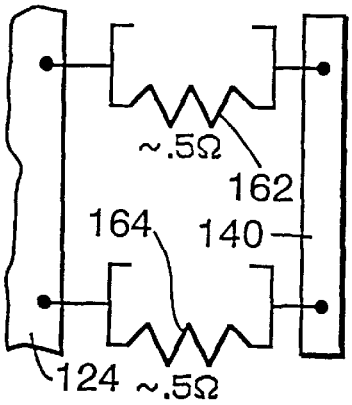
Figure 20:
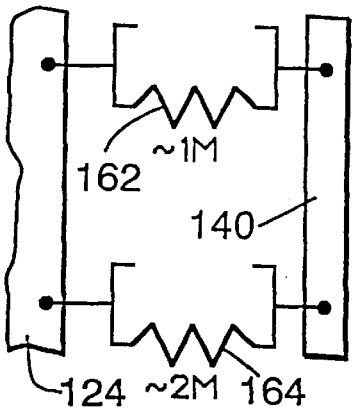
FIGS. 20 and 21 are equivalent circuit diagrams for the switching circuit of FIG. 16 when the circuit is disconnecting the patch from the tuning strip.
Figure 21:
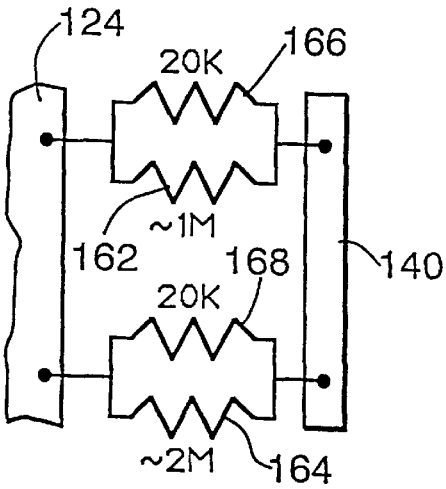

The patch 124 can be connected to the strips 134, 136, 140, 142, 146, 148, 152, and 154 by suitable means such as electronic switches, diodes, field effect transistors (FETs), micro-electro-mechanical systems (MEMS, such as that described in U.S. Pat. No. 5,578,976 to Yao) EM relays and other electronic devices. Preferable circuits 159 and 160 are shown in FIG. 16 and 17 where PIN diodes are biased to either conduct or not conduct with a DC signal to connect a strip to or isolate it from the patch 124. A positive/negative DC power source 161 is used to bias diodes 162 and 164 either into conducting or non-conducting conditions. The DC power source 161 is preferably included in a control system such as that described in more detail hereinbelow. When both diodes 162 and 164 are biased by a positive current from the power source 161 to conduct, the strip 140 is connected to any RF signal on the patch 124 and acts to expand the length thereof and thus lower the resonant frequency of the patch 124. The RF signal passes through a DC blocking capacitor 165 whose capacitance is chosen to act like a short to RF in the frequency band of interest. The RF signal then passes through the diode 164 (which when forward biased appears as a very low resistance of about 0.5Ω), to the strip 140, and through the diode 162 connected between the patch 124 and the strip 140. Balancing resistors 166 and 168 are positioned in parallel to the diodes 162 and 164 respectively. Their resistances are chosen to be relatively high (typically 20 to 500 KΩ). They have no effect when the diodes 162 and 164 are conducting since the impedance of the diodes 162 and 164 is ~40,000 times less, the equivalent circuit at RF being shown in FIG. 18. Since the 0.5Ω diodes 162 and 164 are so much lower in impedance than the 20 KΩ resistors 166 and 168, virtually all the RF current flows through the 0.5Ω diodes 162 and 164, and the 20 KΩ resistors 166 and 168 act like open circuits as shown in FIG. 19. However, when the power source 161 reverse biases the diodes 162 and 164, the diodes 162 and 164 present a very high resistance of 1 MΩ or more, as shown in the equivalent circuit of FIG. 20. The circuit is then a voltage divider. If the diodes 162 and 164 are identical in reverse bias impedance, then the resistors 166 and 168 are not needed because an equal voltage drop occurs across each diode 162 and 164. However, economical bench stock diodes can have an impedance difference as much as 1 MΩ. Therefore, as shown in FIG. 21, the diodes 162 and 164 if mismatched, become components in an unbalanced impedance bridge, which might allow a RF signal to appear on the strip 140. With diode 162 having a reverse bias impedance of 1 MΩ and diode 164 having a reverse bias impedance of 2 MΩ, the voltage division created may not be enough to keep diode 162 biased off when RF is fed to the patch 124. The balancing resistors 166 and 168 avoid the problem by greatly reducing the effect of mismatched diodes since the parallel impedance of 1 MΩ diode 162 and 20 KΩ resistor 166 is 19.6 KΩ, whereas the parallel impedance of 2 MΩ diode 164 and 20 KΩ resistor 168 is 19.8 KΩ resulting in an insignificant voltage division of 49.75% to 50.25% across the diodes 162 and 164 respectively. An RF blocking coil 170 is used to complete the DC circuit to the power source 161 without allowing RF to ground out therethrough.

Figure 22:
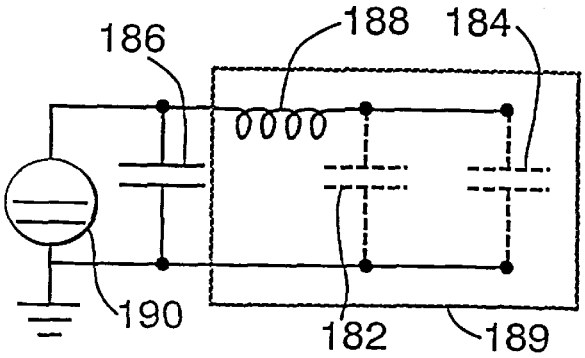
FIG. 22 is an equivalent circuit diagram for the switching circuit of FIG. 17 showing how a tuned filter is formed thereby.

Another connection circuit 160 for connecting the patch 124 to strip 140 utilizing diodes 182 and 184 is shown in FIG. 17 wherein PIN diodes 182 and 184 are connected oriented in the same direction in parallel between the patch 124 and the strip 140 to avoid voltage division therebetween. The circuit 160 includes a capacitor 186 of a capacitance chosen to be a short circuit at RF frequencies and an open circuit at DC and an inductor 188 chosen such that, when combined with the parasitic capacitances of the diodes 182 and 184, the capacitor 186 and inductor 188 form a parallel resonant circuit 189 (FIG. 22). The series connected capacitor 186 and inductor 188 are fed DC therebetween by a DC power source 190 similar to the source 161, which can provide both positive and negative DC current thereto. The patch configuration is essentially the same for the parallel diode circuit 160 as for the series diode circuit 159 as to patch size, number of strips and strips facing. When forward biased by the power source 190, the diodes 182 and 184 conduct from the strip 140 to the patch 124 in a DC sense, thereby forming a low resistance RF path. The advantage of circuit 160 over circuit 159 is that the resistors 166 and 168 are no longer required because the applied voltage is no longer divided between the two diodes 182 and 184. Also, each diode 182 and 184 is reverse biased to the entire output of the power source 190 as opposed to approximately ½ as in the case of circuit 159. This increases the bias voltage allowing the antenna to handle higher RF power or allows a more economical lower power source 190 to be employed.

Figure 23:
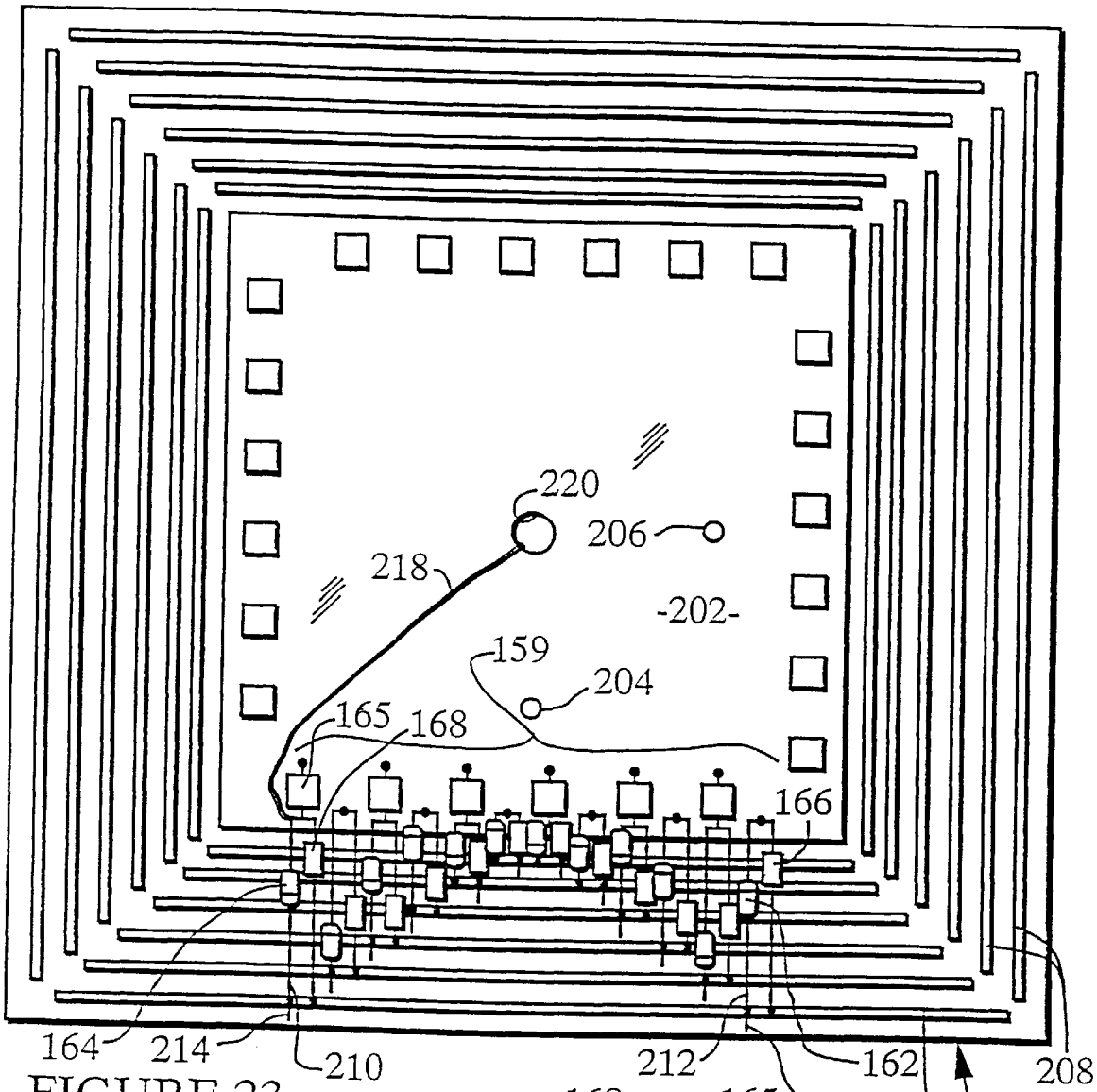
FIG. 23 is a top plan view of a broadband antenna being constructed according to the present invention with some of the switching circuits of FIG. 16 being in place thereon.

The partially constructed antenna 200 of FIG. 23 shows a typical embodiment of the present invention with the switching circuits 159 thereon. Like the aforementioned antennas, antenna 200 includes a patch 202 having feeds 204 and 206 symmetrically positioned at 90° with respect to each other and on the horizontal and vertical axis of the patch 202. A plurality of spaced tuning strips 208 are symmetrically placed around the square patch 202 so that they can effectively increase its size when connected to the patch 202 by the switching circuits 159, one of which switching circuits 159 having the appropriate component numbers indicated, for connecting tuning strip 209 to the patch 202. Note that some of the leads 210 and 212 connecting to the tuning strip 209 extend outwardly beyond the tuning strip 209. The stubs 214 and 216 that result allow fine tuning of the antenna 200 once it has been constructed and can be tested. The stubs 214 and 216 are intentionally made longer than needed and then trimmed off to raise the resonant frequency of the antenna 200 when the strip 209 is connected.

Figure 24:
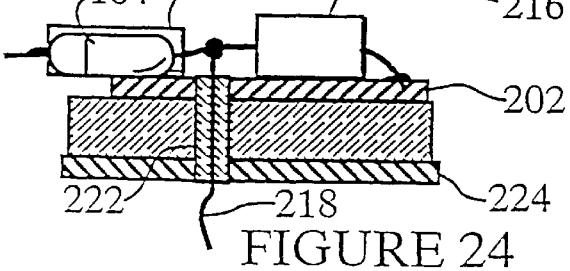
FIG. 24 is an enlarged cross-sectional view of an alternate arrangement to form the switching circuit of FIG. 16 on the antenna of FIG. 23.

The tuning circuits 159 are connected to the power source 161 by suitable leads, such as lead 218, which is shown extending through a center orifice 220 included for that purpose. As shown in FIG. 24, the lead 218 can also be fed through an insulator 222 that extends through the ground plane 224 and the patch 202 to connect to the capacitor 165, the diode 164 and the resistor 168.

Center orifice 220 is preferably a conductive plated-through hole. Conventional microstrip patches employ shorting posts at the center to ground the patch without interfering with the resonant frequency of the dominant mode, since the post location corresponds to a null in the standing wave pattern for vertically-directed electric fields. The benefit of grounding the patch is to protect sensitive electronics (e.g. electronics connected to connector 132) from electrostatic discharges and even lightning strikes. Center orifice 220 of the present invention provides these benefits. Moreover, by being a hollow conductive post, it provides a shielded conduit for leads such as 218.

Further advantages are obtained by providing the center orifice 220 as a hollow conductive post in the tunable patch antenna of the present invention. For example, as seen in FIG. 17, diodes 182 and 184 have cathodes connected directly to the edge of patch 124. This is important particularly in high power applications because the thermal impedance between the diode junction and electrodes is lower on the cathode side than on the anode side. Therefore, heat is more readily removed from the cathode than the anode. When the antenna is transmitting, heat generated from the diodes such as 182 and 184 comprises a dominant portion of the total heat generated within the antenna. By connecting the cathodes to the patch 124, and by providing the conductive center orifice 220, this heat can be transferred across the patch and down the center post to the ground plane. For even better heat transfer, center orifice 220 is preferably made of copper with a minimum cross-sectional area of 0.10–0.40 $in^2$, thereby providing a low thermal resistance between the patch and the housing below the patch. For example, when the center post has an outer diameter of 500 mils, the inner diameter should be at most 350 mils.

As the patch 202 is effectively enlarged by the addition of tuning strips with similar enlargement of the electric field standing wave (see FIG. 2), when the patch is enlarged uniformly, the impedance matches of the feeds 204 and 206 change. The original construction of the antenna 200 can be compromised for this by positioning the feeds 204 and 206 toward the strips so that a perfect impedance match occurs when some of the strips are connected symmetrically, or the strips can be connected asymmetrically so that as the effective patch size of the antenna increases, the effective center of the patch shifts away from the feed to keep its impedance matched. Additional strips 208 on the opposite edge from the feeds 204 and 206 can also be added so that strips can be asymmetrically added over the entire frequency band of the antenna. Which method is used for feed impedance matching in some measure depends on the ability of the connected transmitter or receiver to tolerate antenna feed mismatch and physical constraints that might prevent additional strips on sides opposite from the feeds 204 and 206. Whether any correction for impedance match changes is needed depends on the bandwidth being covered. Experiments have shown that no correction is required for the Satcom band discussed above.

An antenna feed network can be provided to excite the antenna with equal amplitude orthogonal signals for circular polarization. For example, a strip-line feed network such as that described in co-pending application Ser. No. 08/844,929 of Snyder et al., filed Apr. 22, 1997, can be used, the contents of which are incorporated herein by reference.

FIGS. 29 and 30 illustrate still another example of tuning circuits and their arrangement in a patch antenna in accordance with the present invention. FIG. 29 illustrates a portion of antenna 310 having a center patch 312 and tuning strip 314. Tuning strip stubs 316 perpendicularly extend from tuning strip 314 in parallel with each other. Diodes 318 and 320 (preferably PIN diodes) are connected in parallel between tuning strip 314 and center patch 312, with their cathodes connected to center patch 312. An LC branch consisting of capacitor 322 and inductor 324 is connected between the anode of diode 318 and center patch 312. An LC branch consisting of capacitor 326 and inductor 328 is connected between the anode of diode 230 and center patch 312. An additional LC branch consisting of capacitor 330 and inductor 332 is connected in parallel between the connection of capacitor 326 and inductor 328 and center patch 312.

As further illustrated in FIG. 30, DC bias is fed from DC power supply 334 via lead line 336 through center orifice 338 to the connection of capacitor 330 and inductor 332. Center orifice 338 is preferably a copper plated through hole. Antenna 310 further includes an RF feed probe 340, dielectric substrate 342 and ground plane 344. In operation of antenna 310, diodes 318 and 320 are biased in parallel. When the diodes are to be switched on, forward bias current from DC power supply 334 is routed up through center orifice 338, through inductors 332 and 328, and then divides to pass through diodes 318 and 320. Diodes 318 and 320 may be matched (having the same or similar I-V curves). Experience has shown, however, that to achieve an equal current split better than 45%/55%, it is only necessary to purchase diodes 318 and 320 at the same time so that they likely come from the same wafer lot, and hence, will likely have similar DC performance.

When diodes 318 and 320 are forward biased, their RF impedance is primarily resistive and low, about 0.5Ω. Meanwhile, the LC branch comprised of capacitor 322 and inductor 324 (as well as the LC branch comprised of capacitor 326 and inductor 328) has an inductive reactance of several hundred ohms, so these paths offer a relatively high impedance to RF currents, which thereby allows the diode impedance to dominate the "on" performance.

When diodes 318 and 320 are reverse biased, each acts like a fixed, small value capacitor, typically 2 pF or less. Tuning inductors 324 and 328 are chosen to resonate with the diode's "off" capacitance. Diode 318 and inductor 324 (and diode 320 and inductor 328) form a parallel resonant circuit whose resonant frequency is preferably centered within the operational tuning bandwidth of the antenna. These two tuning inductors are essential to obtaining a high impedance for the diodes in their "off" state. Capacitors 322 and 326 are merely RF bypass capacitors. Their values are not critical, and are typically 100–500 pF. They preferably behave as short circuits at RF frequencies.

The benefit of using a separate tuning inductor (having a fixed value) at each PIN diode is that the tuning bar is more effectively decoupled from the patch, which thereby allows the antenna to tune to a higher resonant frequency when the diodes are "off."

Capacitor 326, inductor 332, and capacitor 330 form a pi-network. This is simply a low-pass filter designed to decouple the RF voltage present at the connection between capacitor 326 and inductor 328 from the DC power supply. Typical values for capacitor 330 and inductor 332 are typically 100–500 pF and 270–1000 nH, respectively.

Figure 25B:
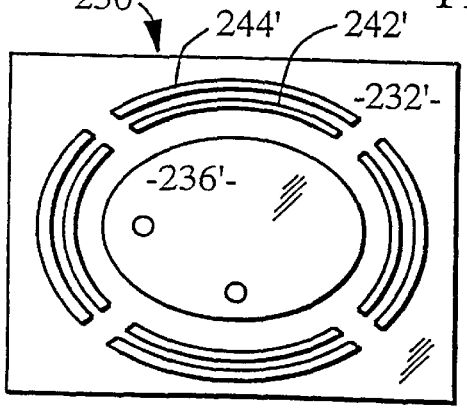
FIG. 25B is a top plan view of a modified version of the antenna of FIG. 25A with an oval patch and segmented concentric tuning strips.
Figure 25A:
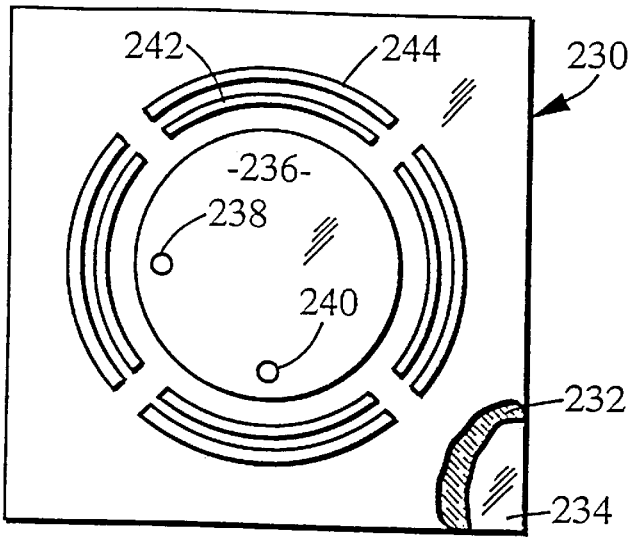
FIG. 25A is a top plan view of an antenna constructed according to the present invention with a two feed circular patch and segmented concentric tuning strips.
Figure 26:
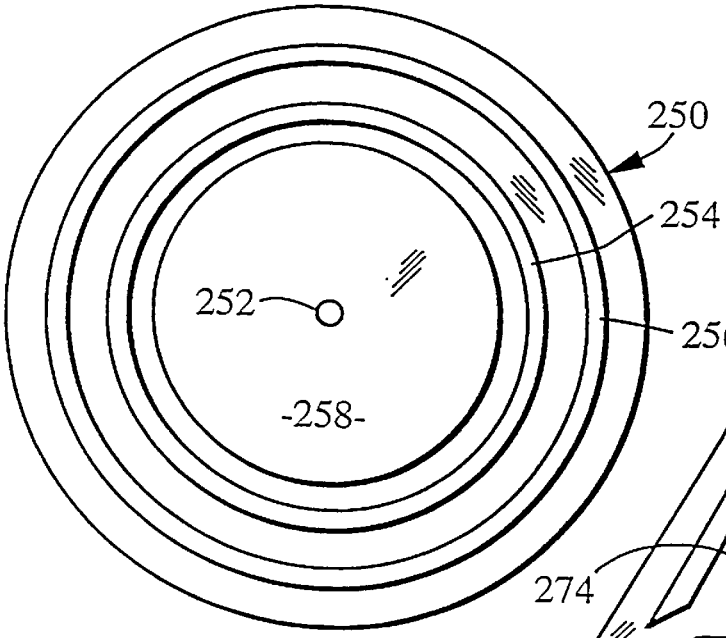
FIG. 26 is a top plan view of an antenna constructed according to the present invention with a center fed circular patch and concentric tuning strips.

Although the invention has been described primarily with square patch antennas, other shapes are possible. For example, in FIG. 25A, a circular antenna 230 is shown mounted over a square dielectric spacer 232 and ground plan 234. The antenna 230 includes a circular patch 236 with two feeds 238 and 240 for polarization control as in the square patch antennas previously described. Two rings of segmented concentric tuning strips 242 and 244 are used to lower the resonant frequency of the antenna 230. FIG. 25B shows a similar antenna 230' where the patch 236' and rings of segmented tuning strips 242' and 244' are oval, showing that the shape of the patches 236 and 236' can be said to be shaped as a plane section of a right circular cone. Another configuration of a circular antenna 250 including the present invention is shown in FIG. 26. The antenna 250 has a central feed 252 and concentric tuning rings 254 and 256 surrounding the patch 258. The antenna 250 therefore has no means to vary the polarization or the antenna pattern, the tuning rings 254 and 256 only being useful in reducing the resonant frequency of the antenna 250.

Figure 27:
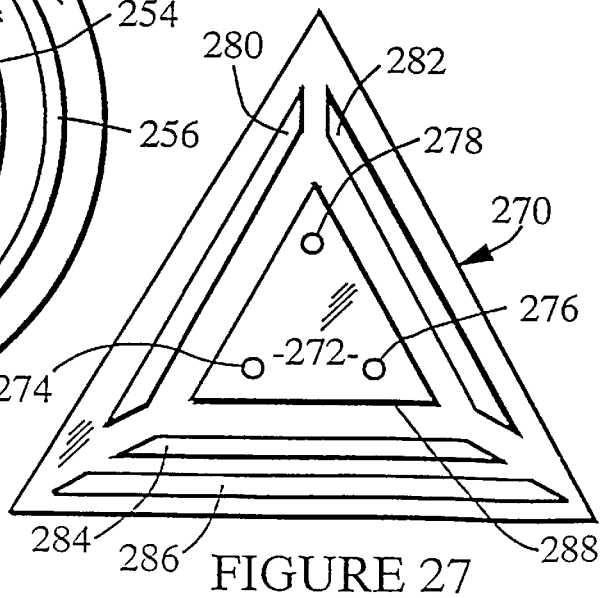
FIG. 27 is a top plan view of an antenna constructed according to the present invention with a triple feed triangular patch and uneven numbers or tuning strips spaced from the edges of the patch.

As shown in FIG. 27, almost any configuration of patches and tuning strips can be employed for special purposes. The antenna 270 of FIG. 27 includes a triangular patch 272 with three feeds 274, 276 and 278 positioned in the corners thereof. The feeds 274, 276 and 278 can be fed out of phase or fed all in the same phase so that they act like a center feed. Note that the upper sides of the triangular patch 272 have associated single tuning strips 280 and 282 while two tuning strips 284 and 286 are provided at the lower edge 288. This configuration would be used if low frequencies are only required with a directed antenna pattern.

Figure 28:
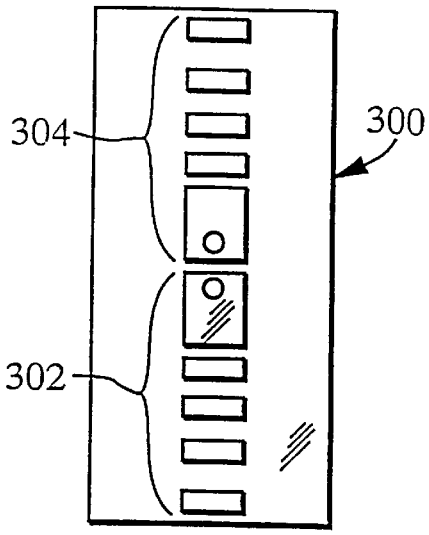
FIG. 28 is a top plan view of a pair of antennas elements constructed according to the present invention positioned back-to-back to form a frequency tunable dipole antenna.

The antenna 300 shown in FIG. 28 is essentially two of the present antennas 302 and 304 positioned back-to-back to form a tunable dipole antenna 300.

FIGS. 31 and 32 illustrate a portion of an antenna 350 having a superstrate. The figures show tuning strips 354 arranged in parallel with the side of square patch 352. Each tuning strip is connected via two tuning strip stubs to switches (PIN diodes) 360 located at the perimeter of the square patch. It should be apparent that it is not possible to print all the traces for the tuning strips and the tuning strip stubs on the same side of a PC board. Accordingly, these traces are preferably printed on both sides of a dielectric superstrate 366 (e.g. double sided PC board) using plated through holes 358 as conductive vias to transition RF currents between opposite sides of the superstrate.

An advantage of building the antenna with a superstrate is that standard assembly techniques for attaching surface mounted electronic components can be utilized. These components will be mounted on the top side of the superstrate 366. The superstrate assembly, including switches 360 can then be DC tested prior to further assembly with the antenna. The antenna dielectric substrate assembly 368 can be fabricated independently from the superstrate assembly, and the two can be readily bolted together. In this case, the center orifice 364 is preferably a hollow copper bolt that can further bolt the antenna to an antenna housing (not shown).

Figure 33:
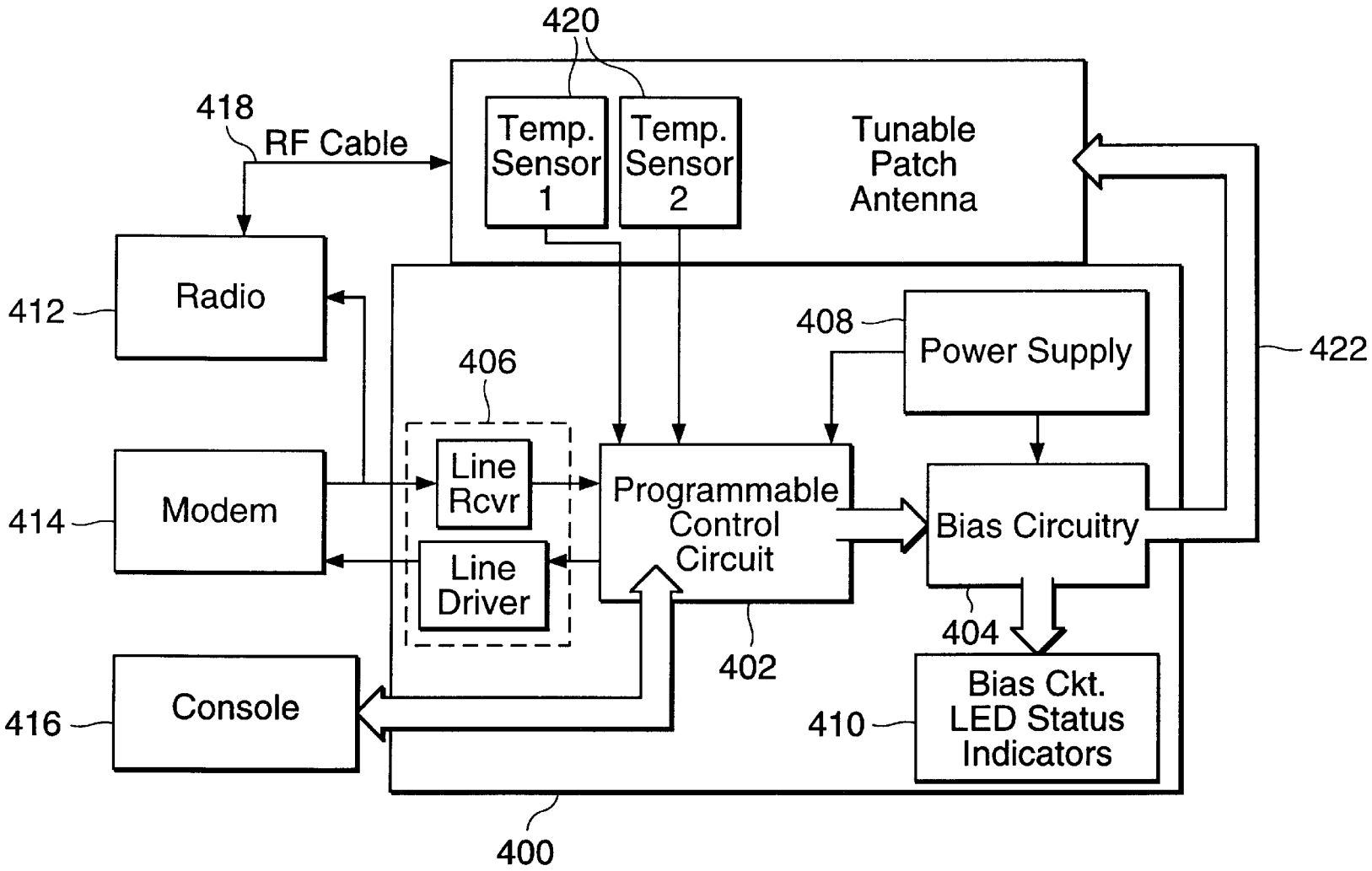
FIG. 33 is a block diagram illustrating a control system for use with a tunable patch antenna according to the present invention.

FIG. 33 is a block diagram of a control system 400 for use with any of the tunable microstrip patch antennas described hereinabove according to the invention. Control system 400 includes a programmable control circuit 402 and a bias control circuit 404. It also includes an interface circuit 406 and a DC power supply 408. Bias control circuit LED status indicators 410 can also be provided for monitoring the operation of the bias control circuit 404.

As can be further seen in FIG. 33, in an example of the antenna system of the invention used in a UHF Satcom application, the control system 400 communicates with a Satcom radio 412, such as an AN/ARC-210, a modem 414, such as a ViaSat MD-1324/U DAMA modem having a MIL-STD-188-114 output port, and a console 416. Radio 412 also communicates with the patch antenna via RF cable 418. Temperature sensors 420 are positioned on the tunable patch antenna so as to provide temperature condition information to control system 400. Bias circuitry 404 communicates with the switching elements in the tunable patch antenna via bias lines 422.

Figure 34:
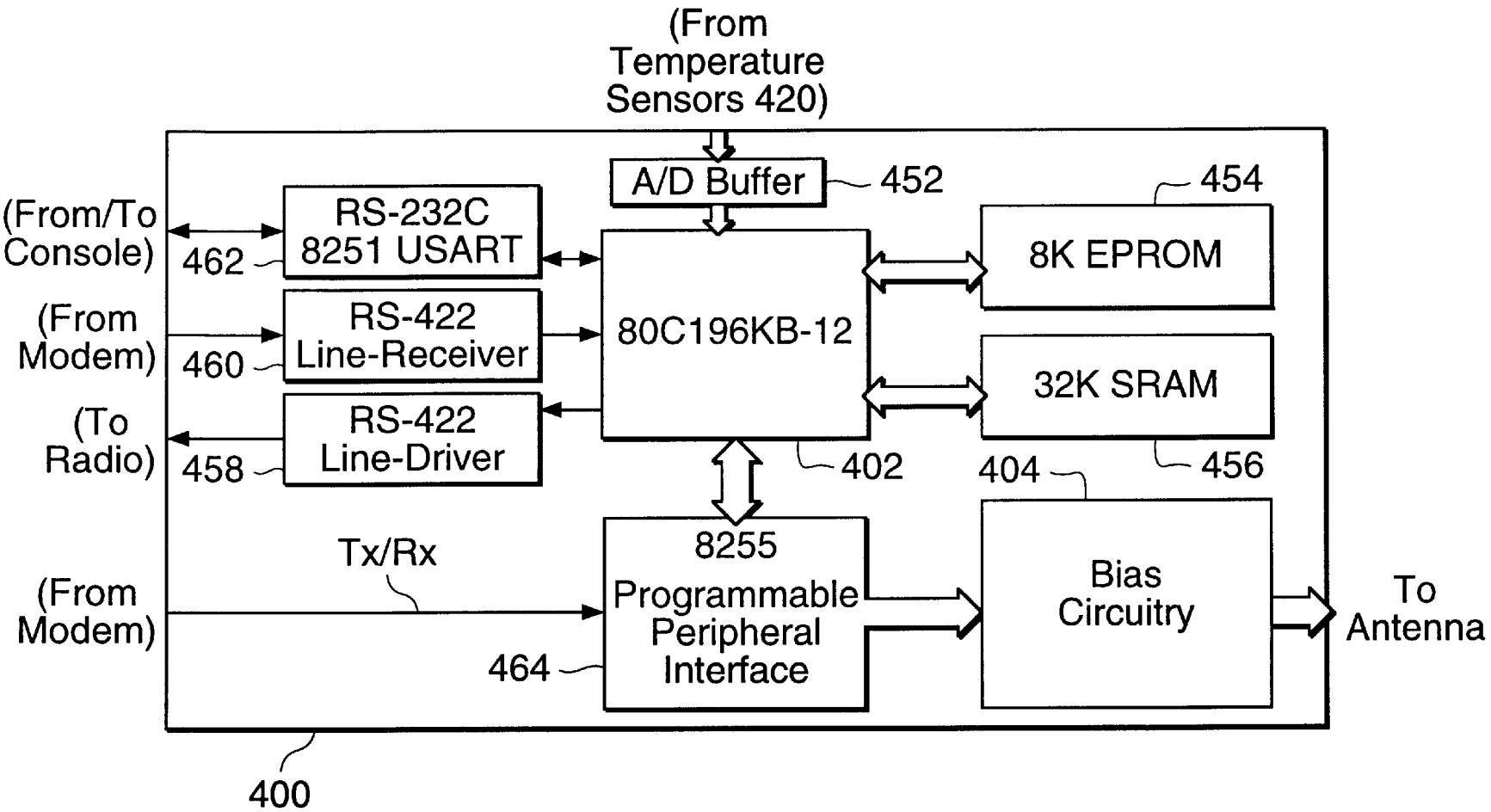
FIG. 34 further illustrates a control system such as that illustrated in FIG. 33.

As shown in FIG. 34, programmable control circuit 402 is preferably embodied primarily by a microcontroller such as an 80C196 manufactured by Intel Corp. Such a microcontroller includes on-board A/D converters for receiving and converting the temperature condition in formation from temperature sensors 420 (via A/D buffer 452), such as an Ad22100 manufactured by Analog Devices, Inc., on-board EPROM 454 and RAM 456 for storing programs and data, and serial ports for communicating with radio 412 via line driver 458 configured as a RS-422 port, modem 414 via line receiver 460 configured as a RS-422 port, and console 416 via UART 462 configured as a RS-232C port. Programmable control circuit 402 can further include a programmable peripheral interface (PPI) 464, preferably embodied by an 8255 manufactured by Intel Corp., for communicating with bias control circuit 404 and for receiving a transmit/receive indicator from modem 414, such as a Keyline signal.

It should be apparent that the programmable control circuit could be implemented in a number of forms rather than a microcontroller. For example, programmable logic could be designed that can operate with minimal propagation delay for responding to certain predetermined commands from modem 414 and causing bias control circuit 404 to configure the antenna correspondingly. However, a microcontroller may be preferred in certain situations where programmability is required or desired, such as the ability to operate in different command environments, the ability to upgrade for different tunable element configurations and algorithms, and the ability to configure for different tolerances and performance constants detected with a particular antenna.

Figure 35:
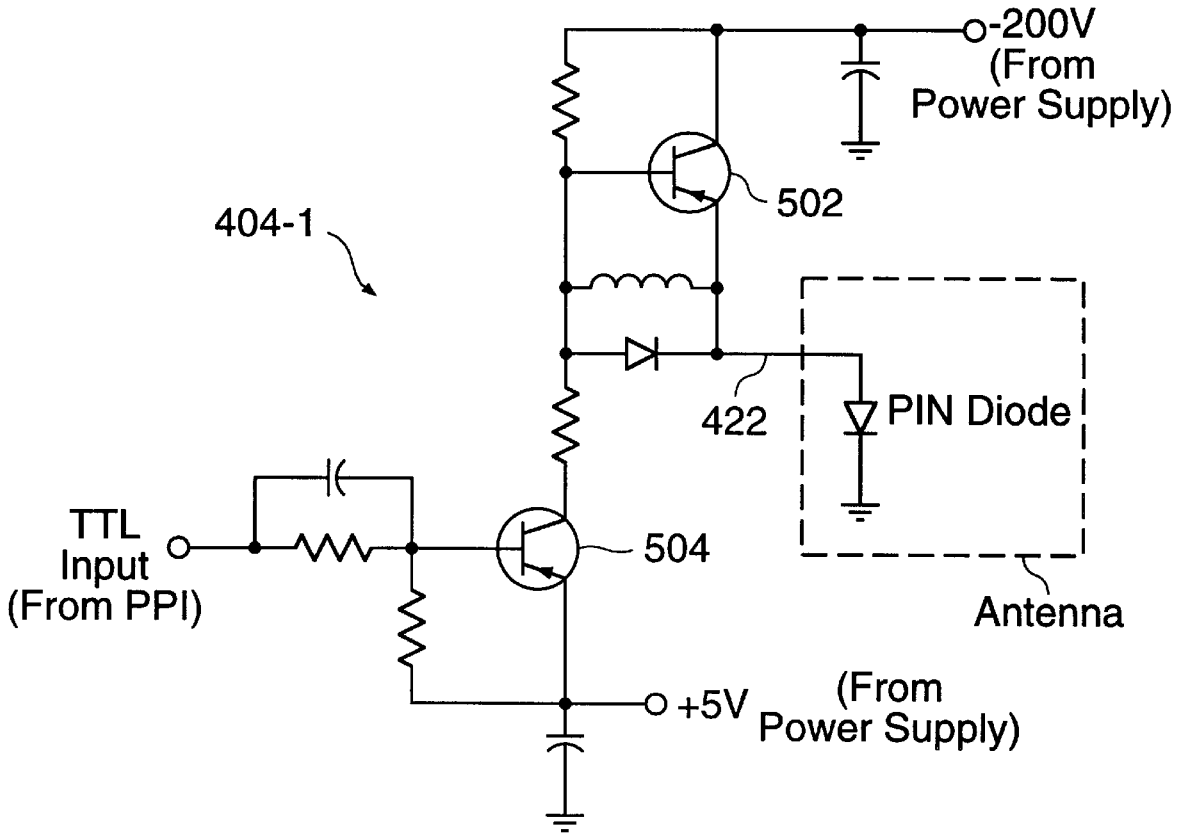
FIG. 35 is a schematic diagram of a bias control circuit constructed in accordance with conventional techniques for use in a control system such as that illustrated in FIG. 34.

An example of a bias control circuit 404 for use in control system 400 is shown in FIG. 35. For clarity, a circuit for controlling only one of the PIN diodes associated with a respective one of the tuning elements in the tunable antenna is shown. However, it should be appreciated that similar circuits exist for each of the PIN diodes to be controlled in the antenna.

As shown in FIG. 35, bias control circuit 404-1 can be constructed in accordance with conventional principles. That is, conventional BJT transistors 502 and 504 can be included for respectively controlling the application of back-biasing and forward-biasing voltages (−200 volts and +5 volts in this example) to the respective PIN diode via a respective one of the bias lines 422 in accordance with a TTL input voltage received from programmable control circuit 402 via PPI 464. Particularly, when the TTL input from the programmable control circuit is a high logic level, BJT transistor 504 is caused to conduct, and BJT transistor 502 is caused to not conduct, thereby causing the forward-biasing voltage to be applied to the PIN diode via bias line 422. Conversely, when the TTL input is a low logic level, BJT transistor 502 is caused to conduct, and BJT transistor 504 is caused to not conduct, thereby causing the back-biasing voltage to be applied to the PIN diode via bias line 422.

Figure 36:
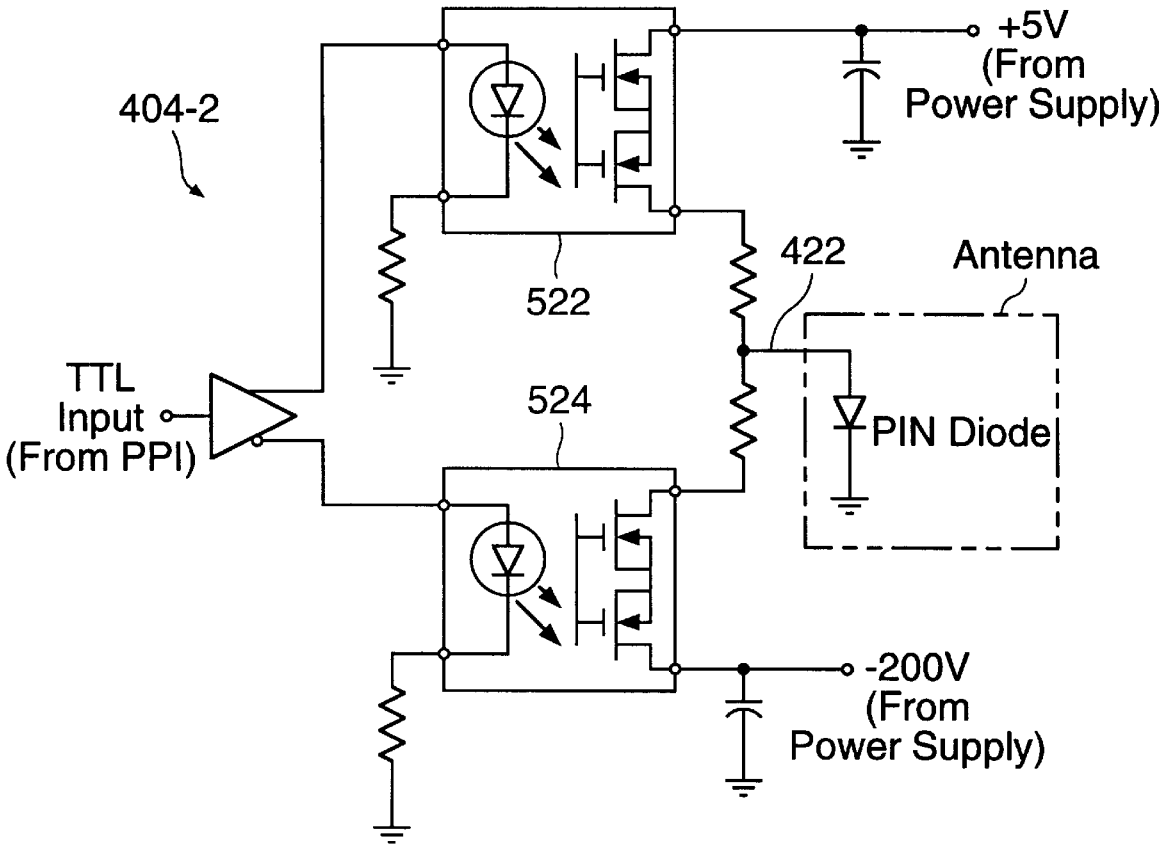
FIG. 36 is a schematic diagram of a preferred bias control circuit for use in a control system such as that illustrated in FIG. 34.

A preferred bias control circuit in accordance with the invention is shown in FIG. 36. In this example, bias control circuit 404-2 includes photovoltaic relays (PVRs) 522 and 524. PVRs 522 and 524 are essentially opto-isolators with low resistance FET output stages. PVRs 522 and 524 respectively control the application of forward-biasing and back-biasing voltages to the respective PIN diode via a respective one of the bias lines 422 in accordance with the TTL input signal received from programmable control circuit 402 via PPI 464.

Only one of the PVRs is switched on at a time. That is, when the TTL input is high, PVR 522 is switched on and PVR 524 is switched off, thereby causing the forward-biasing 5V power supply voltage to be applied to the PIN diode via bias line 422. Conversely, when the TTL input is low, PVR 524 is switched on and PVR 522 is switched off, thereby causing the reverse-biasing-200V power supply voltage to be applied to the PIN diode via bias line 422.

An advantage of using bias control circuit 404-2 with PVRs 522 and 524 instead of BJTs as in the conventionally designed circuit 404-1 is that the PVRs improve isolation between the high DC PIN diode biasing voltages and the TTL voltages of the programmable control circuitry.

Figure 37:
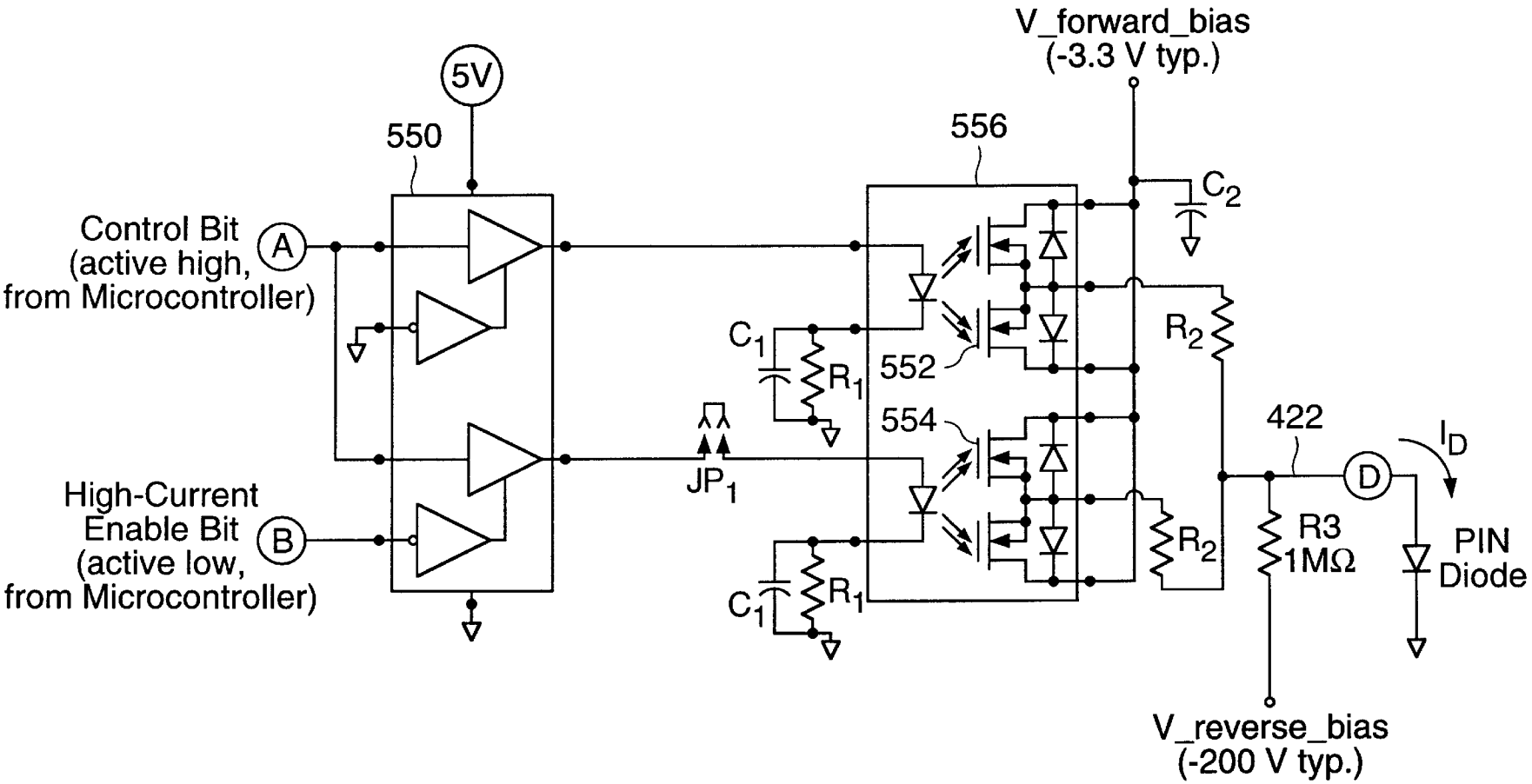
FIG. 37 is a schematic diagram of another preferred bias control circuit for use in a control system such as that illustrated in FIG. 34.

Another preferred bias control circuit in accordance with the invention is shown in FIG. 37. In this example, bias control circuit 404-3 includes a TTL buffer 550 and a PVR circuit 556. TTL buffer 550 receives two TTL inputs from the programmable control circuit, rather than just one in FIGS. 35 and 36. Input A is a control bit corresponding to the TTL input in FIGS. 35 and 36. That is, it has a high logic level when a forward biasing voltage is to be applied to the PIN diode, and a low logic level when a reverse biasing voltage is to be applied to the PIN diode. Input B is a high-current enable bit, and is active low. That is, input B has a low logic level when a high current is to be applied to the PIN diode, and a high logic level when a low current is to be applied. In the example shown in FIG. 37, TTL buffer 550 logically combines the two TTL inputs so that high current can be applied to the PIN diode only when the forward biasing voltage is selected. A jumper JP1 is further included to manually control the selection of the high current, as will be described in more detail hereinafter.

PVR circuit 556 is comprised, for example, by a PVR 3301 made International Rectifier, Inc. PVR circuit 556 can be considered as a pair of PVR relay switches 552 and 554 that can be, in general, operated independently. Moreover, in contrast to the circuit in FIG. 36, in the circuit of FIG. 37, the upper and lower switches 552 and 554 can be turned on at the same time. Particularly, the upper switch 552 is turned "on" to forward-bias the PIN diode at a low current level, and both switches 552 and 554 are turned "on" to forward-bias the PIN diode at a high current level. When both switches 552 and 554 are turned "off," meanwhile, the PIN diode voltage is pulled down to a reverse bias voltage through pull-down resistor R3. The PIN diode current $I_D$ is then a small, negative, leakage current.

The LED's in switches 552 and 554 are current-limited by resistor R1, typically 330 ohms. Capacitor C2 is a speed-up capacitor used to speed up the "off" to "on" propagation delay. Forward bias current levels are defined by the voltage source V_forward_bias (typically 3.3V), along with resistor R2 and the internal resistance of the PVR circuit's FETs. Resistor R2 does not necessarily have to be the same value for both the upper and lower switches, but is typically around 6.8 ohms. Pull-down resistor R3 is large, around 1 megohms, to minimize its internal power dissipation. This is an important consideration when, for example, a large absolute value of the back-bias voltage is needed, as in antenna operations where high RF power is desired.

The controllable high bias current afforded by the circuit design of FIG. 37 is desirable for reducing the RF "on" resistance of the PIN diode. In the antenna constructed according to the invention, this translates into improved radiation efficiency, particularly when multiple tuning elements are sequentially spaced from an edge of the patch, and only one of the tuning elements is to be switched on via bias line 422. Meanwhile, when the resonant frequency of the patch is to be tuned to a resonant frequency that requires multiple ones of the tuning elements to be connected, the radiation efficiency benefits are reduced, while DC power consumption is increased. In these instances, it may be preferable to apply the forward biasing voltages with the low current.

Further flexibility is afforded by the incorporation of jumper JP1. When the jumper is removed, this disables the option of biasing the associated tuning element at the higher current level, even when the programmable control circuit selects the high current. Accordingly, PIN diodes associated with selected tuning elements for which jumper JP1 has been installed can be forward-biased with either of two current levels, while PIN diodes associated with other tuning elements for which jumper JP1 has been removed can only be forward-biased at the low current level, depending on the particular cost (e.g. power consumption) vs. benefit (e.g. radiation efficiency) trade-offs for the particular tuning element.

It should be noted that the circuit design of FIG. 37 can be generalized to cover more than two current levels. This could be accomplished by increasing the complexity of the programmable control circuitry for driving the TTL inputs to each bias control circuit so as to provide, for example, an optimal radiation efficiency for a given consumption of control power.

The number of bias control circuits 404 illustrated in FIGS. 35–37 that are actually implemented in a control system such as that illustrated in FIG. 34 depends on the number of tuning elements and associated switching elements employed in the tunable microstrip patch antenna constructed in accordance with the invention. In one example of the invention, the antenna contains fourteen tuning and switching elements, and thus fourteen associated bias control circuits 404 are coupled between PPI 464 and respective switching elements via bias lines 422. The control system is programmed to control each of these tuning elements (connect them to or isolate them from the tuning patch) in up to 65.536 different combinations, thus enabling the antenna system to be tuned to 65.536 tuning states PPI 464 can include two 8-bit ports A and B for supplying the TTL inputs (seven bits for each port) to bias control circuits 404 in accordance with the configuration of tuning elements determined by programmable control circuit 402.

Figure 38:
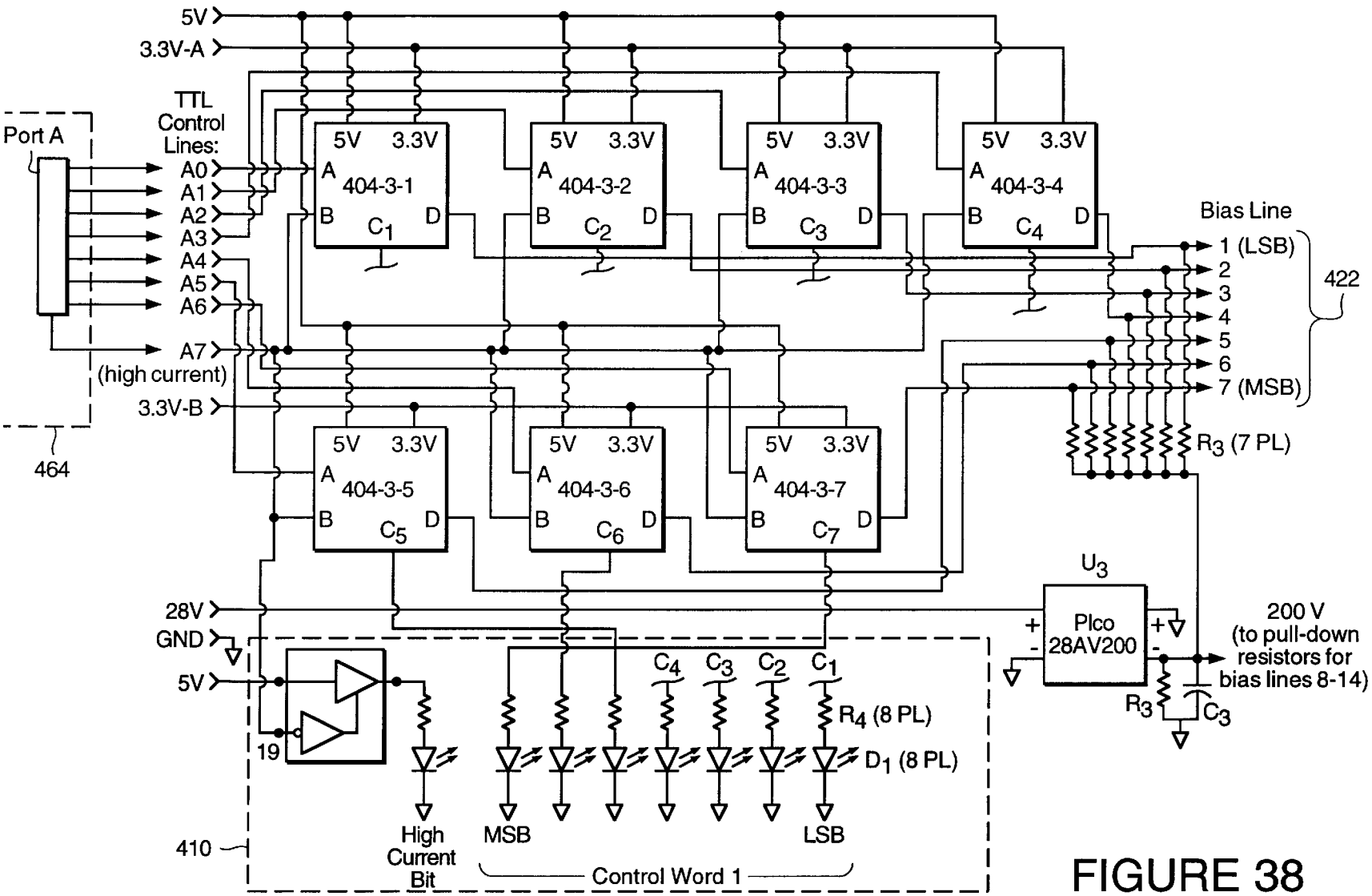
FIG. 38 is a schematic diagram illustrating the configuration of multiple bias control circuits for respectively controlling the application of bias voltages to bias lines in a control system such as that illustrated in FIG. 34.

FIG. 38 illustrates how multiple bias control circuits of the control system can be configured in conformance with the description above. For clarity, a configuration for converting TTL inputs from only one of the 8-bit ports from PPI 464, into bias voltages applied to corresponding bias lines 422, is shown. Moreover, although FIG. 38 employs the preferred example of bias control circuits 404-3 illustrated in FIG. 37, the configuration can be applied to the circuits shown in FIGS. 35 and 36, as well as other bias control circuits in accordance with the principles of the invention, with modifications readily apparent to those skilled in the art.

In the example shown in FIG. 38, bits 0 to 6 of port A of PPI 464 respectively supply TTL bias control input A as shown in FIG. 37 to bias control circuits 404-3-1 to 404-3-7. Bit 7 of port A commonly supplies TTL high current enable input B as shown in FIG. 37 to circuits 404-3-1 to 404-3-7. Therefore, the bias voltages and currents appearing on bias lines 422-1 to 422-7 are controlled according to the 8-bit control word written to port A of PPI 464.

Programmable control circuit 402 can store look up tables for quickly causing the appropriate biasing voltages to appear on bias lines 422 via bias control circuits 404 and PPI 464 in response to a desired frequency command decoded from modem 414 or directly from radio 412. The bias voltages correspond to the combination of tuning elements to be connected to the patch so that the resonant frequency of the antenna approaches the desired frequency commanded. If none of the stored combinations results in a resonant frequency exactly that of the desired frequency, the combination resulting in the closest resonant frequency is chosen. Programmable control circuit 402 can also be responsive to temperature conditions sensed from temperature sensors 420 to account for changes in the predetermined resonant frequencies caused by temperature changes in the antenna.

In a DAMA application, for example, programmable control circuit 402 preferably stores up to three transmit/receive frequency pairs for immediate tuning. In response to a DAMA tuning command, programmable control circuit 402 writes an eight-bit word to port A of PPI 464 and an eight-bit word to port B of PPI 464, thus causing the appropriate bias voltages to appear on the bias lines 422.

Figure 39:
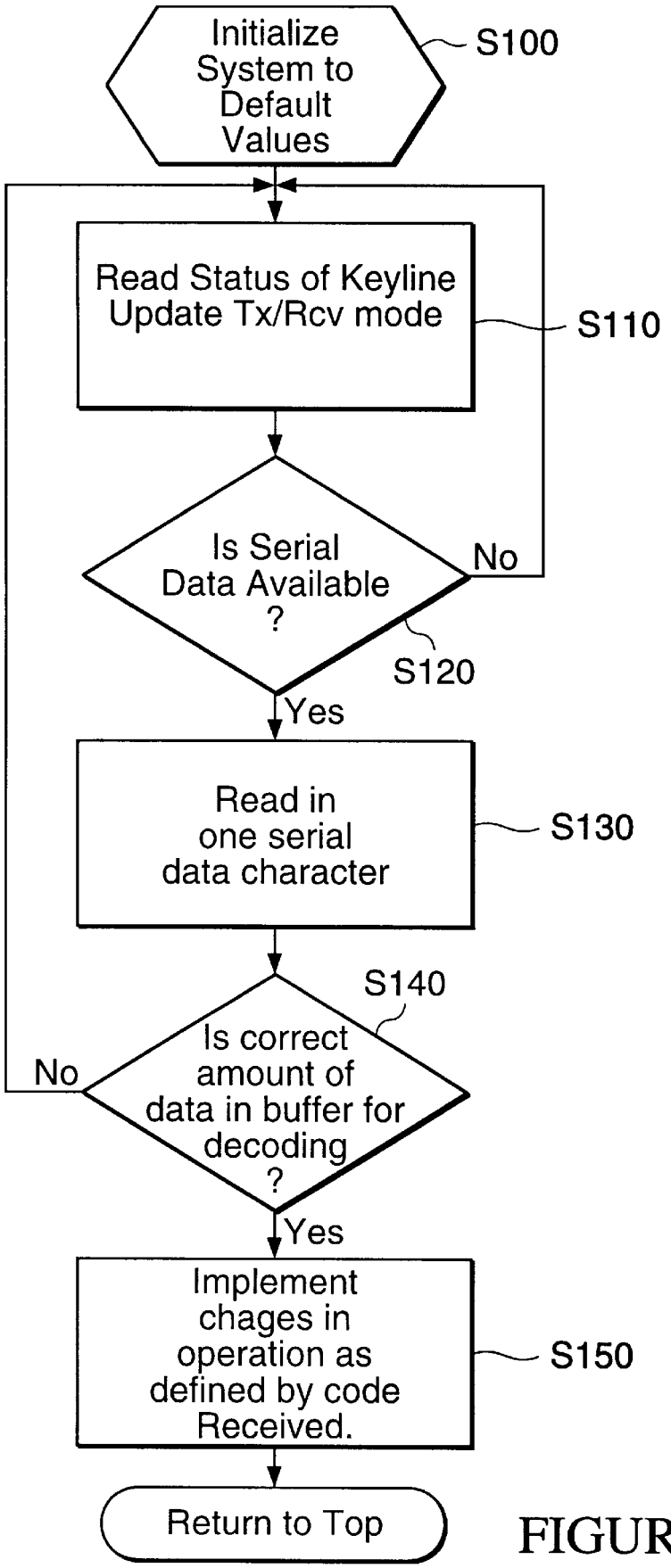
FIG. 39 is a flowchart illustrating the operation of a programmable control circuit in a control system such as that illustrated in FIG. 34.

FIG. 39 is a flowchart describing the operation of an antenna control system in accordance with the invention. After initialization (S100), the system enters a loop for polling for frequency change and transmit/receive change commands sent to radio 412 by modem 414. In step S110, the status of the Keyline command is monitored, and if a change between transmit and receive is required, the antenna is configured to be tuned to the transmit or receive frequency. Next, in step S120, the output of modem 414 is polled to see if any new serial data corresponding to a frequency change is output. If not, control is returned to step S110. If serial data is available, control proceeds to step S130, where the serial data is read. At step S140, the serial data is checked to see if the correct amount of data has been received for decoding a command. If not, control returns to step S110. Otherwise, control advances to step S150, where the processing for causing the bias control circuit 404 to appropriately configure the antenna is performed.

The table below shows the types of commands decoded and responded to in an example of the control system of the invention operating in a UHF Satcom environment with DAMA mode support. Preferably, all unrelated commands are ignored.

| Command Code | Description |
|---|---|
| 0 × 15 | Immediate tune to DAMA frequency pair 1 |
| 0 × 16 | Immediate tune to DAMA frequency pair 2 |
| 0 × 17 | Immediate tune to DAMA frequency pair 3 |
| 0 × C6 | Channel Update |
| 0 × D9 | DAMA Frequency Pair load |
| 0 × 05 | RT Status Request |
| 0 × 18 | BIT Results Request |

Accordingly, for example, when the serial data read in step S130 and decoded in step S150 corresponds to command code 0×15, the TTL signals for causing the bias control circuits to configure the tuning elements to alter the resonant frequency of the patch for the transmit or receive frequency (in correspondence with the Keyline command) stored for pair 1 is written to ports A and B of PPI 464, thus causing the predetermined combination of tuning elements of the tunable antenna to be biased into conduction or isolation from the patch, thereby tuning the antenna to the desired frequency.

The control system having the components described above is capable of tuning the antenna to the desired frequency with minimal delay. For example, experimental results for performing a transmit-to-receive frequency switch show a response time of about 52 microseconds between a detection of a keyline command and a change of the input to the bias circuitry. Experimental results for performing a receive-to-transmit frequency switch show a response time of about 46 microseconds. And experimental results for performing a DAMA frequency pair select command show a response time of about 382 microseconds, well within the 875 microsecond requirement allotted by the DAMA frame structure.

Figure 40:
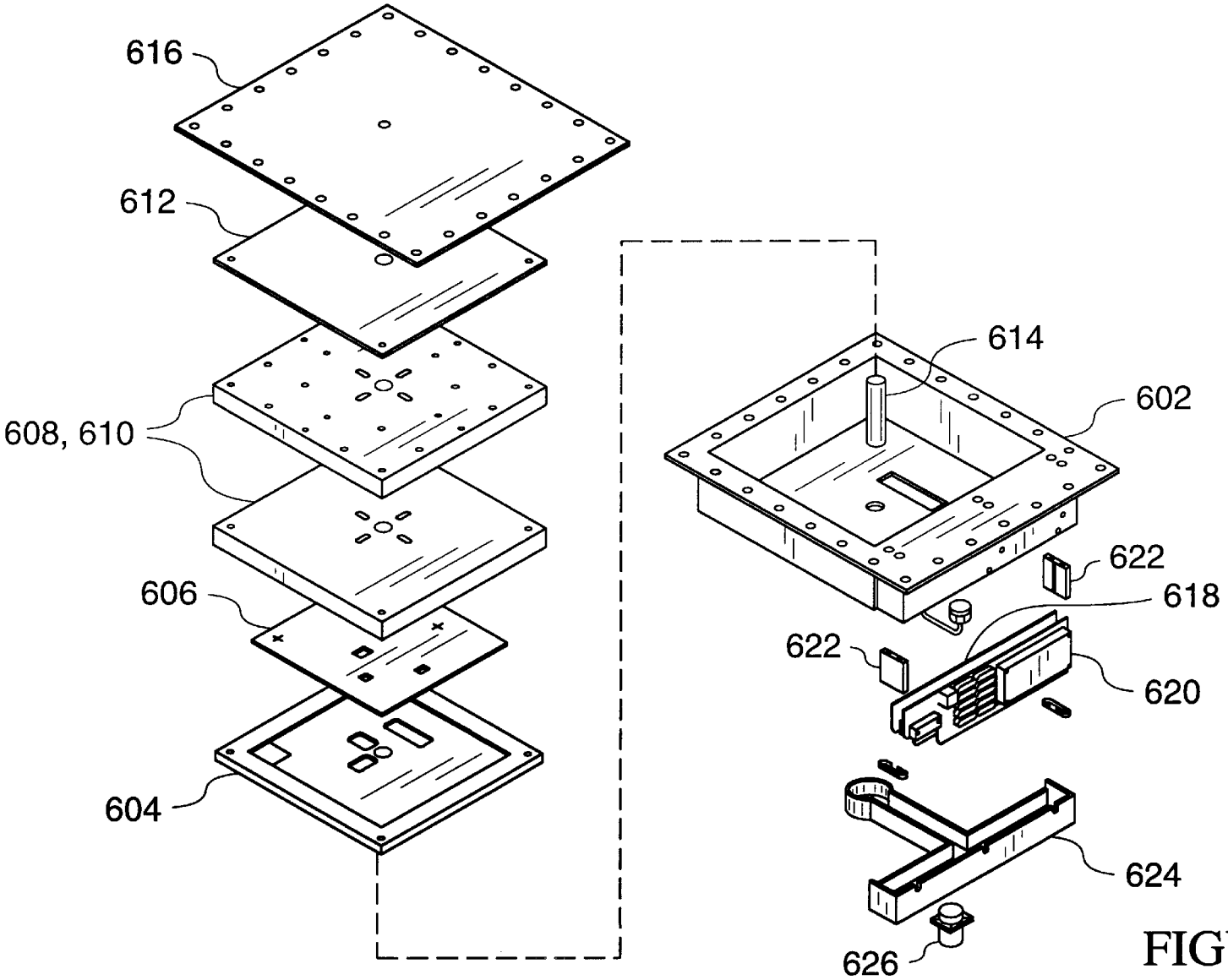
FIG. 40 is a perspective assembly drawing showing an example of how an integrated tunable patch antenna and control system therefor can be assembled in accordance with the invention.

FIG. 40 illustrates how a tunable patch antenna and control system therefor can be integrated into a compact assembly structure. A housing 602 is provided in which a heat spreader 604, a stripline feed network 606, dielectric (e.g. ceramic) substrates 608, 610, superstrate (e.g. PC Card) 612 are sequentially placed. A center post 614 is fitted through center holes provided in each of the assembly cards, and is used to provide a passage through which bias lines (not shown) are fed. A dielectric radome 616 is installed over the housing 602. The control system is mounted outside the housing with microcontroller board 618 and bias control board 620 installed thereupon by card guides 622. A cover and cable raceway 624 is fitted over boards 618 and 620 and a serial data port 626 is fitted thereon. When assembled as described above, a UHF Satcom antenna in accordance with the invention meeting the aforementioned broadband capabilities and DAMA performance requirements can be provided by an 8" by 8" aperture and overall depth of 4" to the end of the serial data connector, making it ideal for many space-constrained applications.

Thus, there have been shown and described novel antennas and associated control systems which fulfill all of the objects and advantages sought therefor. Many changes, alterations, modifications and other uses and application of the subject antennas and systems will become apparent to those skilled in the art after considering the specification together with the accompanying drawings. All such changes, alterations and modifications which do not depart from the spirit and proper legal scope of the invention are deemed to be covered by the invention, as defined by the claims which follow.

We claim:

1. An antenna including:

a ground plane that is electrically conductive having a first side surface;

a first patch that is electrically conductive having:
at least one edge; and
a first side surface;

a dielectric layer positioned between said first patch and said ground plane, said dielectric layer including:
a first side surface in contact with said first side surface of said first patch; and
a second side surface in contact with said first side surface of said ground plane;

at least one tuning strip that is electrically conductive spaced from said at least one edge of said first patch and spaced from said ground plane by said dielectric layer;

an RF feed connected to said first patch;

switch means to electrically connect and disconnect RF energy between said at least one tuning strip and said first patch; and a control system coupled to said switch means that applies predetermined DC biases to cause said switch means to electrically connect and disconnect RF energy between said at least one tuning strip and said first patch.

2. An antenna as defined in claim 1, wherein said control system includes:

a bias control circuit that applies said predetermined DC biases to said switch means via a bias line; and a programmable control circuit that controls the operation of said bias control circuit to apply said predetermined DC biases in accordance with a desired frequency.

3. The antenna as defined in claim 2, wherein said bias control circuit is coupled between said bias line and first and second predetermined bias voltages, said programmable control circuit controlling the operation of said bias control circuit such that only one of said first and second predetermined bias voltages is applied to said bias line.

4. The antenna as defined in claim 3, wherein said programmable control circuit causes said bias control circuit to apply said first predetermined bias voltage to said bias line in accordance with a first desired frequency, and causes said bias control circuit to apply said second predetermined bias voltage to said bias line in accordance with a second desired frequency different than said first desired frequency.

5. The antenna as defined in claim 2, wherein said bias control circuit includes first and second photovoltaic relays respectively coupled between said bias line and first and second predetermined bias voltages, said first and second photovoltaic relays being controlled such that only one of said first and second predetermined bias voltages is applied to said bias line.

6. The antenna as defined in claim 2, wherein said bias control circuit includes first and second photovoltaic relays coupled between said bias line and first and second predetermined bias voltages, said first and second photovoltaic relays being controlled such that only one of said first and second predetermined bias voltages is applied to said bias line, said first and second photovoltaic relays also being controlled such that only one of first and second predetermined bias currents is applied to said bias line.

7. The antenna as defined in claim 6, wherein said programmable control circuit causes said bias control circuit to apply said first predetermined bias current to said bias line in accordance with a first radiation efficiency, and causes said bias control circuit to apply said second predetermined bias current to said bias line in accordance with a second radiation efficiency different than said first radiation efficiency.

8. The antenna as defined in claim 6, wherein said bias control circuit applies said first and second predetermined bias voltages and said first and second predetermined bias currents in response to logic signals having logic states that are determined by said programmable control circuit, said bias control circuit further including a logic buffer that logically combines said logic signals and outputs said logically combined logic signals to said first and second photovoltaic relays.

9. The antenna as defined in claim 8, further including a jumper disposed between said logic buffer and said first and second photovoltaic relays that permits manual override of said logically combined logic signals so that only one of said first and second predetermined bias currents is applied to said bias line regardless of said logic states of said logic signals.

10. The antenna as defined in claim 2, further including a temperature sensor disposed at a predetermined position relative to said first patch, and wherein said programmable control circuit controls the operation of said bias control circuit in accordance with a detected temperature received from said temperature sensor.

11. The antenna as defined in claim 1, wherein said switch means includes first and second diodes connected in parallel between said at least one tuning strip and said first patch, said first and second diodes each having their cathode sides connected to said first patch.

12. The antenna as defined in claim 11, wherein said switch means further includes:

a first series connection of a capacitor and an inductor connected between an anode terminal of said first diode and said first patch, said capacitor being connected to said first patch and said inductor being connected to said anode terminal of said first diode;

a second series connection of a capacitor and an inductor connected between an anode terminal of said second diode and said first patch, said capacitor being connected to said first patch and said inductor being connected to said anode terminal of said second diode, said predetermined DC biases being applied at a connection point between said capacitor and said inductor.

13. The antenna as defined in claim 11, wherein said switch means further includes:

a first series connection of a capacitor and an inductor connected between an anode terminal of said first diode and said first patch, said capacitor being connected to said first patch and said inductor being connected to said anode terminal of said first diode;

a second series connection of a capacitor and an inductor connected between an anode terminal of said second diode and said first patch, said capacitor being connected to said first patch and said inductor being connected to said anode terminal of said second diode;

a third series connection of a capacitor and an inductor connected between a connection point between said capacitor and said inductor of said second series connection and said first patch, said capacitor being connected to said first patch and said inductor being connected to said connection point, said predetermined DC biases being applied at a connection point between said capacitor and said inductor of said third series connection.

14. An antenna system including:

an antenna having:

a first patch that is electrically conductive and is dimensioned such that it has a resonant frequency when RF energy is fed thereto, a tuning strip that, when RF energy is electrically connected between said tuning strip and said first patch, changes said resonant frequency of said first patch, and a switch that electrically connects and disconnects RF energy between said first patch and said tuning strip;

an RF feed that feeds RF energy to said first patch; and a control system coupled to said switch that applies predetermined DC biases to cause said switch to electrically connect and disconnect RF energy between said tuning strip and said first patch.

15. An antenna as defined in claim 14, wherein said control system includes:

a bias control circuit that applies said predetermined DC biases to said switch via a bias line; and a programmable control circuit that controls the operation of said bias control circuit to apply said predetermined DC biases in accordance with a desired frequency so that said resonant frequency of said first patch approaches said desired frequency.

16. The antenna as defined in claim 15, wherein said bias control circuit is coupled between said bias line and first and second predetermined bias voltages, said programmable control circuit controlling the operation of said bias control circuit such that only one of said first and second predetermined bias voltages is applied to said bias line.

17. The antenna as defined in claim 16, wherein said programmable control circuit causes said bias control circuit to apply said first predetermined bias voltage to said bias line in accordance with a first desired frequency, and causes said bias control circuit to apply said second predetermined bias voltage to said bias line in accordance with a second desired frequency different than said first desired frequency.

18. The antenna as defined in claim 15, wherein said bias control circuit includes first and second photovoltaic relays respectively coupled between said bias line and first and second predetermined bias voltages, said first and second photovoltaic relays being controlled such that only one of said first and second predetermined bias voltages is applied to said bias line.

19. The antenna as defined in claim 15, wherein said bias control circuit includes first and second photovoltaic relays coupled between said bias line and first and second predetermined bias voltages, said first and second photovoltaic relays being controlled such that only one of said first and second predetermined bias voltages is applied to said bias line, said first and second photovoltaic relays also being controlled such that only one of first and second predetermined bias currents is applied to said bias line.

20. The antenna as defined in claim 19, wherein said programmable control circuit causes said bias control circuit to apply said first predetermined bias current to said bias line in accordance with a first radiation efficiency, and causes said bias control circuit to apply said second predetermined bias current to said bias line in accordance with a second radiation efficiency different than said first radiation efficiency.

21. A method of controlling an antenna having a first patch that is electrically conductive and is dimensioned such that said first patch has a resonant frequency when RF energy is fed thereto, and a plurality of tuning strips, each of said tuning strips, when RF energy is electrically connected between said each tuning strip and said first patch, changes said resonant frequency of said first patch, said method comprising:

connecting RF energy between certain of said tuning strips and said first patch while isolating other of said tuning strips from said first patch in accordance with a desired frequency so that said resonant frequency of said first patch approaches said desired frequency;

preparing a table for respectively associating a plurality of predetermined combinations of said tuning strips with a plurality of predetermined resonant frequencies;

receiving said desired frequency;

looking up one of said predetermined resonant frequencies closest to said desired frequency in said table; and controlling the connection of RF energy between said first patch and one of said predetermined combinations of said tuning strips associated with said one of said predetermined resonant frequencies.

22. The method as defined in claim 21, further comprising:

detecting a temperature of said antenna; and adjusting the connection of RF energy between certain of said tuning strips and said first patch in accordance with said detected temperature and said desired frequency.

23. The method as defined in claim 21, wherein said step of connecting RF energy between certain of said tuning strips and said first patch while isolating other of said tuning strips from said first patch includes controlling application of a first predetermined bias voltage to switch elements coupled between said certain of said tuning strips and said first patch while controlling application of a second predetermined bias voltage to switch elements coupled between said other of said tuning strips and said first patch.

24. An antenna including:

a ground plane that is electrically conductive having a first side surface;

a superstrate having a first side surface and a second side surface opposite said first side surface;

a first patch on said first side surface of said superstrate, said first patch being electrically conductive and having at least one edge;

a dielectric layer positioned between said superstrate and said ground plane, said dielectric layer including:

a first side surface in contact with said first side surface of said superstrate; and a second side surface in contact with said first side surface of said ground plane;

at least one tuning strip on said second side surface of said superstrate that is electrically conductive, said tuning strip being spaced from said at least one edge of said first patch and spaced from said ground plane by said dielectric layer and said superstrate;

an RF feed connected to said first patch;

a switch, responsive to an applied DC bias, that electrically connects and disconnects RF energy between said at least one tuning strip and said first patch.

25. The antenna as defined in claim 24, further comprising:

a plated through center hole through said first patch, said superstrate, said dielectric layer and said ground plane.

26. The antenna as defined in claim 25, wherein said center hole is thermally and electrically conductive.

27. The antenna as defined in claim 26, wherein said center hole is a hollow copper bolt.

28. The antenna as defined in claim 26, wherein said center hole is comprised of copper having a minimum cross-sectional area of about 0.10 $in^2$.

29. The antenna as defined in claim 25, further comprising:

a lead line for supplying said applied DC bias to said switch that is fed through said center hole.

* * * * *